US009357812B2

(12) United States Patent
Elbaz et al.

(10) Patent No.: US 9,357,812 B2
(45) **Date of Patent: *Jun. 7, 2016**

(54) PROPRIOCEPTIVE/KINESTHETIC APPARATUS AND METHOD

(71) Applicant: APOS—MEDICAL AND SPORTS TECHNOLOGIES LTD., Herzliya (IL)

(72) Inventors: Avi Elbaz, Dimona (IL); Amit Mor, Rehovot (IL)

(73) Assignee: APOS—Medical and Sports Technologies Ltd., Herzliya (IL)

( * ) Notice: Subject to any disclaimer, the term of this patent is extended or adjusted under 35 U.S.C. 154(b) by 0 days.

This patent is subject to a terminal disclaimer.

(21) Appl. No.: 14/283,400

(22) Filed: May 21, 2014

(65) Prior Publication Data

US 2014/0317959 A1 Oct. 30, 2014

Related U.S. Application Data

(63) Continuation-in-part of application No. 14/270,712, filed on May 6, 2014, now Pat. No. 9,055,788, which is a continuation of application No. 12/825,684, filed on Jun. 29, 2010, now Pat. No. 8,758,207, which is a continuation-in-part of application No. 12/636,800, filed on Dec. 14, 2009, now abandoned, which is a continuation-in-part of application No. 10/222,992, filed on Aug. 19, 2002, now Pat. No. 6,979,287.

(51) Int. Cl.

| | |
|---|---|
| ***A63B 21/00*** | (2006.01) |
| ***A43B 5/18*** | (2006.01) |
| ***A43B 7/14*** | (2006.01) |
| ***A43B 13/14*** | (2006.01) |

(52) U.S. Cl.
CPC . *A43B 5/18* (2013.01); *A43B 7/144* (2013.01); *A43B 7/1445* (2013.01); *A43B 13/145* (2013.01); *A63B 21/0004* (2013.01)

(58) Field of Classification Search
USPC ..... 482/1–148; 36/88
See application file for complete search history.

(56) References Cited

U.S. PATENT DOCUMENTS

| | | | |
|---|---|---|---|
| 1,021,142 | A | 3/1912 | Freeman |
| 1,529,421 | A | 3/1925 | Dowdell |
| 1,736,576 | A | 11/1929 | Cable |
| 2,303,744 | A | 12/1942 | Jacobs |

(Continued)

FOREIGN PATENT DOCUMENTS

| | | |
|---|---|---|
| DE | 1907894 | 1/1965 |
| DE | 29902731 | 3/2000 |

(Continued)

OTHER PUBLICATIONS

ISR of WO 2004/016321 (or PCT/IL2003/000668), mailed on Mar. 26, 2004 (8 pages).

(Continued)

*Primary Examiner* — Stephen Crow
(74) *Attorney, Agent, or Firm* — Roach Brown McCarthy & Gruber, P.C.; Kevin D. McCarthy

(57) ABSTRACT

A footwear which includes a support member having an inner sole and an upper surface attachable to a foot, and two bulbous protuberances protruding from a lower surface of the support member on opposite sides of a latitudinal midline, is provided.

20 Claims, 15 Drawing Sheets

(56) References Cited

U.S. PATENT DOCUMENTS

| | | | | |
|---|---|---|---|---|
| 3,082,549 | A | 3/1963 | Dolceamore | |
| 3,402,485 | A | 9/1968 | McMorrow | |
| 3,526,976 | A | 9/1970 | Jacobs | |
| 3,552,043 | A | 1/1971 | Moffa | |
| 3,782,011 | A | 1/1974 | Fisher | |
| 3,859,736 | A | 1/1975 | Hill | |
| 3,916,538 | A | 11/1975 | Loseff | |
| 3,940,128 | A | 2/1976 | Ragone | |
| 4,030,213 | A | 6/1977 | Daswick | |
| 4,071,963 | A | 2/1978 | Fukuoka | |
| 4,241,523 | A | 12/1980 | Daswick | |
| 4,348,821 | A * | 9/1982 | Daswick | 36/103 |
| RE31,173 | E | 3/1983 | Daswick | |
| 4,586,706 | A | 5/1986 | Chen | |
| 4,629,181 | A | 12/1986 | Krive | |
| 4,653,748 | A | 3/1987 | Seel | |
| 4,660,826 | A | 4/1987 | Lee | |
| 4,739,986 | A | 4/1988 | Kucharik | |
| 4,821,432 | A | 4/1989 | Reiber | |
| 4,892,090 | A | 1/1990 | Kaeser | |
| 5,035,418 | A | 7/1991 | Harabayashi | |
| 5,337,494 | A | 8/1994 | Ricker | |
| D357,347 | S | 4/1995 | Leick | |
| 5,518,476 | A | 5/1996 | McLeon | |
| 5,533,282 | A | 7/1996 | Kataoka | |
| 5,549,527 | A | 8/1996 | Yu | |
| 5,584,787 | A | 12/1996 | Guidry | |
| 5,603,334 | A | 2/1997 | Sharp | |
| 5,643,145 | A | 7/1997 | Lo | |
| 5,682,690 | A | 11/1997 | Chang | |
| D394,343 | S | 5/1998 | Marshall | |
| D394,541 | S | 5/1998 | Burgess | |
| 5,848,954 | A | 12/1998 | Stearns | |
| 5,897,464 | A | 4/1999 | McLeod | |
| 5,902,214 | A | 5/1999 | Makikawa | |
| D412,393 | S | 8/1999 | Aquino | |
| 6,019,712 | A | 2/2000 | Duncan | |
| 6,063,046 | A | 5/2000 | Allum | |
| 6,102,832 | A | 8/2000 | Tani | |
| 6,126,577 | A | 10/2000 | Chang | |
| 6,176,817 | B1 | 1/2001 | Carey | |
| 6,277,057 | B1 | 8/2001 | Hayden | |
| 6,283,897 | B1 | 9/2001 | Patton | |
| D448,920 | S | 10/2001 | Montross | |
| 6,311,416 | B1 | 11/2001 | Cohen | |
| 6,315,786 | B1 | 11/2001 | Smuckler | |
| 6,393,735 | B1 | 5/2002 | Berggren | |
| 6,511,404 | B2 | 1/2003 | Tu | |
| 6,551,225 | B1 | 4/2003 | Romero | |
| 6,652,432 | B2 | 11/2003 | Smith | |
| D482,851 | S | 12/2003 | McClaskie | |
| 6,692,419 | B2 | 2/2004 | Chen | |
| D488,915 | S | 4/2004 | Girbaud | |
| 6,792,703 | B2 | 9/2004 | Cohen | |
| 6,793,609 | B1 | 9/2004 | Fan | |
| 6,796,056 | B2 | 9/2004 | Swigart | |
| 6,811,523 | B1 | 11/2004 | Timmer | |
| 6,979,287 | B2 | 12/2005 | Elbaz | |
| 7,004,895 | B2 | 2/2006 | Perry | |
| 7,081,070 | B1 | 7/2006 | Washington | |
| 7,101,330 | B2 | 9/2006 | Elbaz | |
| 7,287,340 | B2 * | 10/2007 | Talbott | 36/25 R |
| D648,517 | S | 11/2011 | Vestuti | |
| 8,079,159 | B1 | 12/2011 | Rosa | |
| 8,959,798 | B2 * | 2/2015 | Pfister | 36/30 R |
| 2002/0026730 | A1 | 3/2002 | Whatley | |
| 2002/0092201 | A1 | 7/2002 | Kraeuter | |
| 2003/0148865 | A1 | 8/2003 | Handshoe | |
| 2004/0053751 | A1 | 3/2004 | Pizolato | |
| 2009/0113760 | A1 | 5/2009 | Dominguez | |
| 2010/0251565 | A1 | 10/2010 | Litchfield | |
| 2011/0072684 | A1 | 3/2011 | Stubblefield | |
| 2014/0109444 | A1 * | 4/2014 | Dumont | 36/25 R |

FOREIGN PATENT DOCUMENTS

| | | |
|---|---|---|
| DE | 10133863 | 2/2003 |
| EP | 925809 | 6/1999 |
| FR | 1128009 | 1/1957 |
| JP | 61119282 | 6/1986 |
| JP | 08000763 | 1/1996 |
| JP | 9308706 | 12/1997 |
| JP | 2000084035 | 3/2000 |
| NL | 8502659 | 4/1987 |
| WO | 9831245 | 7/1998 |
| WO | 0137693 | 5/2001 |
| WO | 0237995 | 5/2002 |
| WO | 2004016321 A2 | 2/2004 |

OTHER PUBLICATIONS

The Gait Cycle as found at http://www.upstate.edu/cbd/education/grossanat/limbs6.shtml (2013).

* cited by examiner

PROPRIOCEPTIVE/KINESTHETIC APPARATUS AND METHOD

CROSS REFERENCE TO RELATED APPLICATIONS

This application is a Continuation-in-Part of U.S. patent application Ser. No. 14/270,712, filed May 6, 2014; which is a continuation of U.S. patent application Ser. No. 12/825,684, filed on Jun. 29, 2010 (allowed); which is a continuation-in-part of U.S. patent application Ser. No. 12/636,800, filed Dec. 14, 2009 (abandoned), which is a continuation-in-part of U.S. patent application Ser. No. 10/222,992, filed Aug. 19, 2002 (now U.S. Pat. No. 6,979,287, issued on Dec. 27, 2005), the contents of which all are incorporated herein by reference in their entirety.

FIELD OF INVENTION

The present invention relates generally to apparatus for training, developing and enhancing proprioceptive and kinesthetic skills, neuromuscular control and core stability.

BACKGROUND OF THE INVENTION

Proprioception refers to the ability to know where a body part is located in space and to recognize movements of body parts (such as fingers and toes, feet and hands, legs and arms). Kinesthesia is a related term, and refers to the sensation by which position, weight, muscle tension and movement are perceived. In some of the medical literature, proprioception refers to the conscious and unconscious appreciation of joint position, while kinesthesia refers to the sensation of joint velocity and acceleration. Proprioception is often used interchangeably with kinesthesia, and herein as well, the terms will be used interchangeably. (Throughout the specification and claims, the term "proprioception" will be used to encompass proprioception, kinesthesia, core stability and the like.)

The neuromuscular control system of the body integrates peripheral sensations relative to joint loads and processes these signals into coordinated motor responses. This muscle activity serves to protect joint structures from excessive strain.

Certain mechanoreceptors are present throughout the soft tissues of the musculoskeletal system which interact with the central nervous system and coordinate body movements, postural alignment, and balance. Mechanoreceptors are located in the muscles, tendons, ligaments, joint capsules and the skin. These nerve fibers provide information to the brain regarding the status and function of the musculoskeletal system. The mechanoreceptors send electrical signals along peripheral nerves to the spinal cord. The electrical signals travel via the spinal cord to the brain where the signals are interpreted to recognize movements of body parts, muscle tension, movement and the like.

Some examples of mechanoreceptors for controlling the muscular system include muscle spindles. Muscle spindles are found interspersed within the contractile fibers of skeletal muscles, with the highest concentration in the central portion of each muscle. Muscle spindle fibers respond to changes in the length of muscles. These nerve endings provide the central nervous system information used to maintain muscle tone and the correct muscle tension on opposite sides of each joint.

Fibrous tissues that surround and protect most joints generally contain a variety of sensory nerve endings for proprioception and kinesthesia. The input from these sensory nerve endings provides the central nervous system information regarding the location, stretch, compression, tension, acceleration, and rotation of the joint.

The foot is the anatomical region that contains the second largest number of proprioceptive or kinesthetic sensory receptors in the body (the spine has the most).

Proprioceptive and kinesthetic exercises and exercise devices are well known for improving agility, balance and coordination, and for rehabilitation of persons whose proprioceptive ability has been impaired, such as after accidents or illness. One such class of exercise devices includes tilt boards, wherein a patient stands on a board or similar platform that has a ball mounted underneath. The board does not lie horizontal due to the presence of the ball, and this challenges the ability of the patient to balance and perform maneuvers on the platform. Repeated exercises on the tilt board may be used to develop or rehabilitate the proprioception and neuromuscular control of the patient, as well as strengthen muscles, tendons and connective tissues in the foot area.

Other known proprioceptive and kinesthetic exercise devices include a shoe with a single ball mounted underneath the sole of the shoe. The shoe with the ball is used similar to the tilt board. Another kind of shoe has a rod mounted underneath the sole of the shoe, used for strengthening dorsiflexor muscles.

Yet another proprioceptive and kinesthetic exercise device is described in U.S. Pat. No. 6,283,897 to Patton. This device consists of one or more pegs protruding upwards from a baseboard. The pegs have a rounded top and sit in concave depressions (divots) in the bottom of an overshoe shaped like a sandal. Specifically, the bottom of the shoe's sole has three concave, hemisphere-shaped divots, with one located within the heel portion, one directly underneath the ball of the foot, and one located in the center. Elastomeric bands may support the user's foot as the user turns his foot and/or hips to develop the strength, range of motion, and proprioception of the ankle and hips.

SUMMARY OF THE INVENTION

There is thus provided, according to embodiments of the present invention, there is provided footwear that includes a support member having an upper surface attachable to a foot, and two bulbous protuberances, a forward bulbous protuberance and rearward bulbous protuberance. Each of the protuberances has a curved outer contour, and protrudes from a lower surface of the support member on opposite sides of a latitudinal midline. The latitudinal midline is halfway between a calcaneus support portion and a phalanges support portion of the support member. The forward bulbous protuberance is positioned medially offset with respect to a longitudinal centerline and the rearward bulbous protuberance is positioned laterally offset with respect to the longitudinal centerline.

Furthermore, according to embodiments of the present invention, the longitudinal centerline is defined as a longitudinal straight line connecting middles of the short sides of a rectangle which delimits a contour of the support member.

Furthermore, according to embodiments of the present invention, the contour is a contour of a foothold confined by an upper part of the footwear.

Furthermore, according to embodiments of the present invention, the contour is an outermost contour of the footwear.

Furthermore, according to embodiments of the present invention, the contour is the contour of a bottom surface of a sole of the footwear.

Furthermore, according to embodiments of the present invention, the height of the forward bulbous protuberance is greater than the height of the rearward bulbous protuberance.

Furthermore, according to embodiments of the present invention, the height of the rearward bulbous protuberance is greater than the height of the forward bulbous protuberance.

Furthermore, according to embodiments of the present invention, there is provided footwear that includes a support member having an upper surface attachable to a foot, and two bulbous protuberances, a forward bulbous protuberance and rearward bulbous protuberance. Each of the protuberances has a curved outer contour, and protrudes from a lower surface of the support member on opposite sides of a latitudinal midline. The forward bulbous protuberance is positioned laterally offset with respect to a longitudinal centerline and the rearward bulbous protuberance is positioned medially offset with respect to the longitudinal centerline.

Furthermore, according to embodiments of the present invention, there is provided footwear that includes a support member having an upper surface attachable to a foot, and two bulbous protuberances, a forward bulbous protuberance and rearward bulbous protuberance. Each of the protuberances has a curved outer contour, and protrudes from a lower surface of the support member on opposite sides of a latitudinal midline. The height of the forward bulbous protuberance is greater than the height of the rearward bulbous protuberance.

Furthermore, according to embodiments of the present invention, there is provided footwear that includes a support member having an upper surface attachable to a foot, and two bulbous protuberances, a forward bulbous protuberance and rearward bulbous protuberance. Each of the protuberances has a curved outer contour, and protrudes from a lower surface of the support member on opposite sides of a latitudinal midline. The height of the rearward bulbous protuberance is greater than the height of the forward bulbous protuberance.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
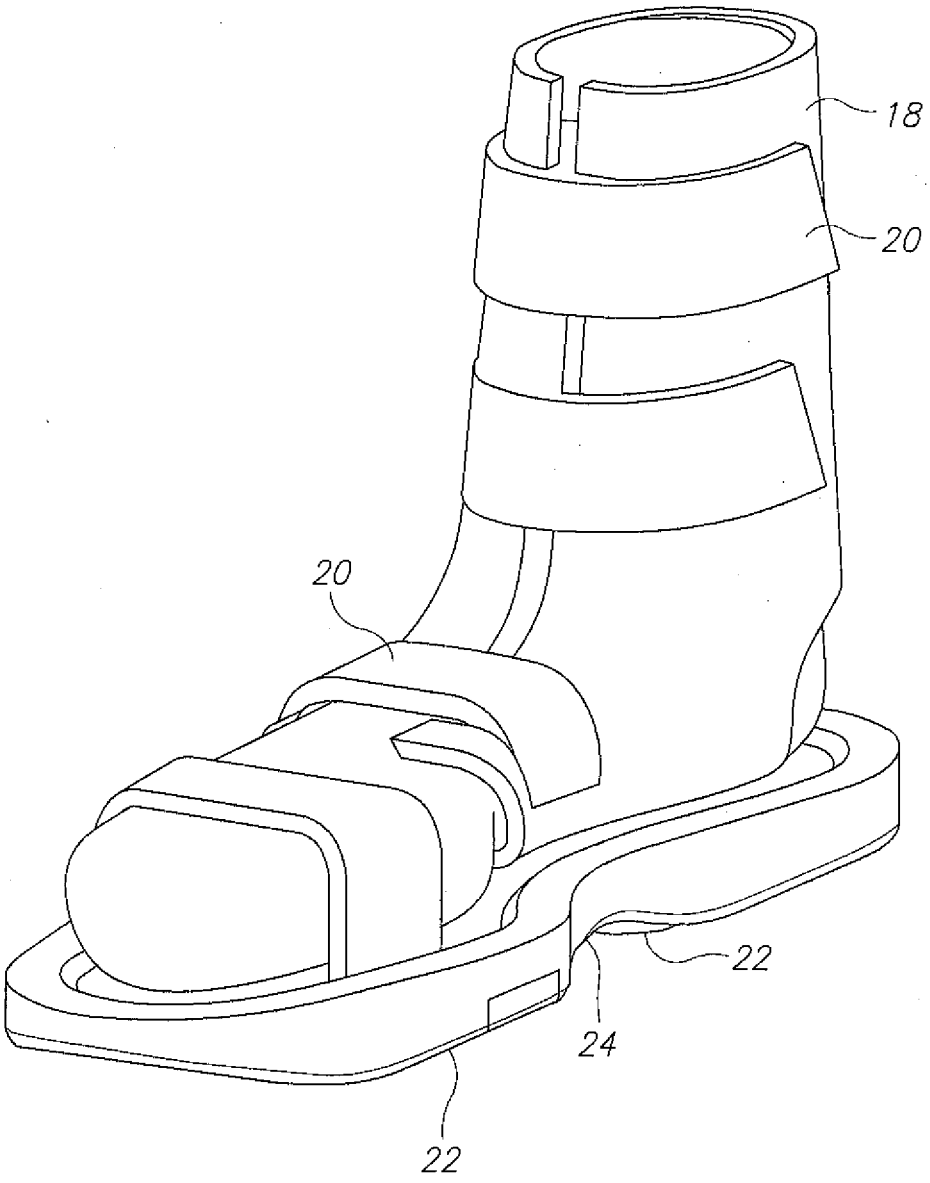
FIG. 1 is a simplified pictorial illustration of footwear constructed and operative in accordance with an embodiment of the present invention.

Reference is now made to FIGS. 1-4, which illustrate footwear 10 constructed and operative in accordance with an embodiment of the present invention. Footwear 10 may be supplied as one or more pairs of shoe-like devices, or alternatively, as just one of the shoe-like devices.

Footwear 10 preferably comprises a support member 12 having a periphery in a shape of a shoe sole with an upper surface 14. In the illustrated embodiment, the upper surface 14 is indented with a peripheral ridge 16, but it is appreciated that other configurations of upper surface 14 are within the scope of the invention. Footwear 10 may be attached to a foot of a user (not shown) by means of a boot 18 and/or fasteners 20, such as but not limited to, VELCRO straps, buckles, shoe laces, and the like. Boot 18 may be fashioned for attachment to the user's foot with or without fasteners 20. Similarly, fasteners 20 may be used to attach footwear 10 to the user's foot without boot 18.

In another embodiment, footwear comprises an inner sole (insole) and an outer sole. In another embodiment, inner sole is equivalent to the maximal contour line defining the representative footwear last or shoe last. In one embodiment, footwear is a shoe or a pair of shoes.

In another embodiment, footwear comprises an outer sole (outsole). In another embodiment, outer sole is the bordering contour line of a shoe surface facing the ground. In another embodiment, outer sole is the layer facing the ground. In another embodiment, a protuberance's base contacts the outer sole. In another embodiment, a spacer contacts the outer sole. In another embodiment, a protuberance extends from the outer sole). In another embodiment, outer sole is synonymous with "perimeter outer sole" or "the bordering contour line of a shoe surface facing the ground" or "ground outer sole" or "the layer facing the ground or "layer adapted to engage a ground surface".

Two bulbous protuberances 22 may protrude from a lower surface 24 of support member 12. Alternatively, bulbous protuberances 22 may protrude from the upper surface 14 of support member 12. Each protuberance 22 may have a curved outer contour 26. The cross-section of the contour 26, that is, either the cross-section taken with respect to a longitudinal axis 28 (FIG. 4) of support member 12 (corresponding to the shape seen in FIG. 2) or the cross-section taken with respect to a latitudinal axis 30 (FIG. 4) of support member 12 (corresponding to the shape seen in FIG. 3), or any other cross-section, may have any curvilinear shape. For example, the contours 26 may have the shape of a conic section, that is, the shape of a circle, ellipse, parabola or hyperbola. The various cross-sections of the contours 26 of protuberance 22 may be shaped identically or differently.

Figure 2:
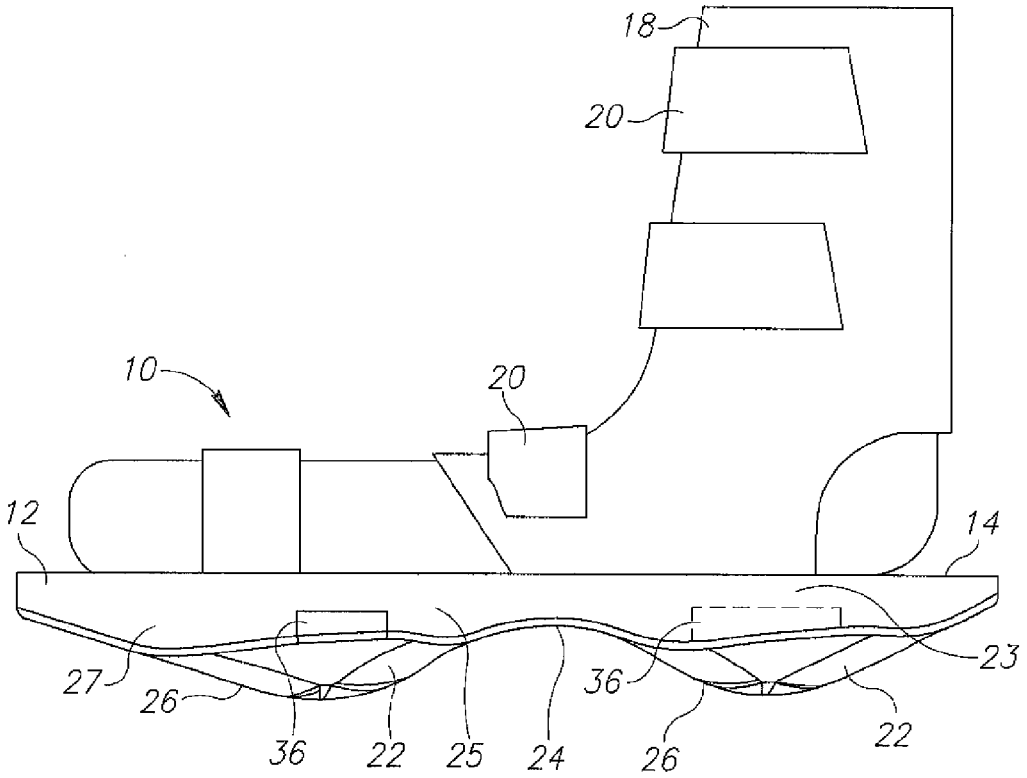
FIGS. 2 and 3 are simplified side-view and rear-view illustrations, respectively, of the footwear of FIG. 1.
Figure 4:
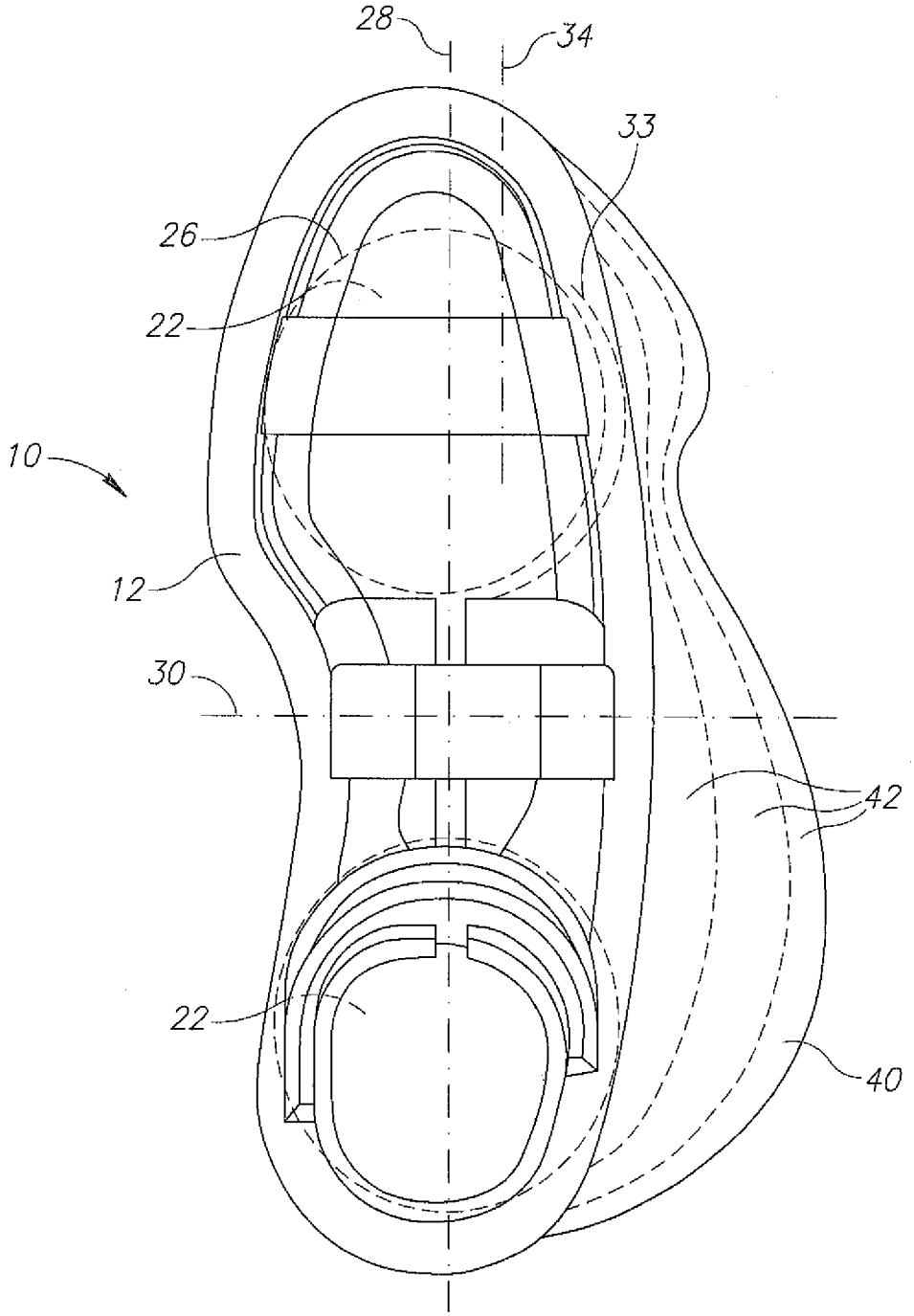
FIG. 4 is a simplified top-view illustration of the footwear of FIG. 1, showing further features of other embodiments of the present invention.

As seen clearly in FIG. 2, one protuberance 22 may be positioned more posteriorly than the other protuberance 22. As seen in FIG. 4, the protuberances may be positioned on a common longitudinal axis of support member 12, such as the centerline 28 of support member 12, and on opposite sides of the latitudinal midline 30. As seen in FIG. 2, the rearward protuberance 22 may be positioned generally underneath a calcaneus (heel, ankle) support portion 23 of support member 12, while the forward protuberance 22 may be positioned generally underneath a metatarsals support portion 25 and/or phalanges support portion 27 of support member 12.

According to embodiments of the present invention, the longitudinal centerline is defined as a longitudinal straight line connecting middles of the short sides of a rectangle which delimits a contour of the support member.

Alternatively, as indicated by broken lines 33 in FIG. 4, one of the protuberances 22 (e.g., the forward one) may be aligned on a longitudinal axis 34 offset from centerline 28, and the rearward protuberance 22 may be positioned offset from axis 34, such as on the centerline 28. It is appreciated that the above are just some examples of positioning the protuberances 22, and many other possibilities exist within the scope of the invention.

The protuberances 22 may be constructed of any suitable material, such as but not limited to, elastomers or metal or a combination of materials, and may have different properties. For example, the protuberances may have different resilience or hardness, such as having different elasticity properties or Shore hardness. The protuberances 22 may protrude by different amounts from the lower surface 24 of support member 12.

In accordance with an embodiment of the present invention, one or more protuberances 22 may be slidingly mounted on support member 12. For example, protuberance 22 may be mounted on a track 36 (FIG. 2) formed in the lower surface 24 of support member 12, and may be selectively positioned anywhere along the track and fastened thereto. Track 36 may extend along a portion of the shoe sole or all along the length of the shoe sole. Alternatively or additionally, the amount of protrusion of protuberance 22 may be adjusted, such as by mounting protuberance 22 with a threaded fastener 38 (FIG. 3) to support member 12 and tightening or releasing threaded fastener 38.

Figure 3:
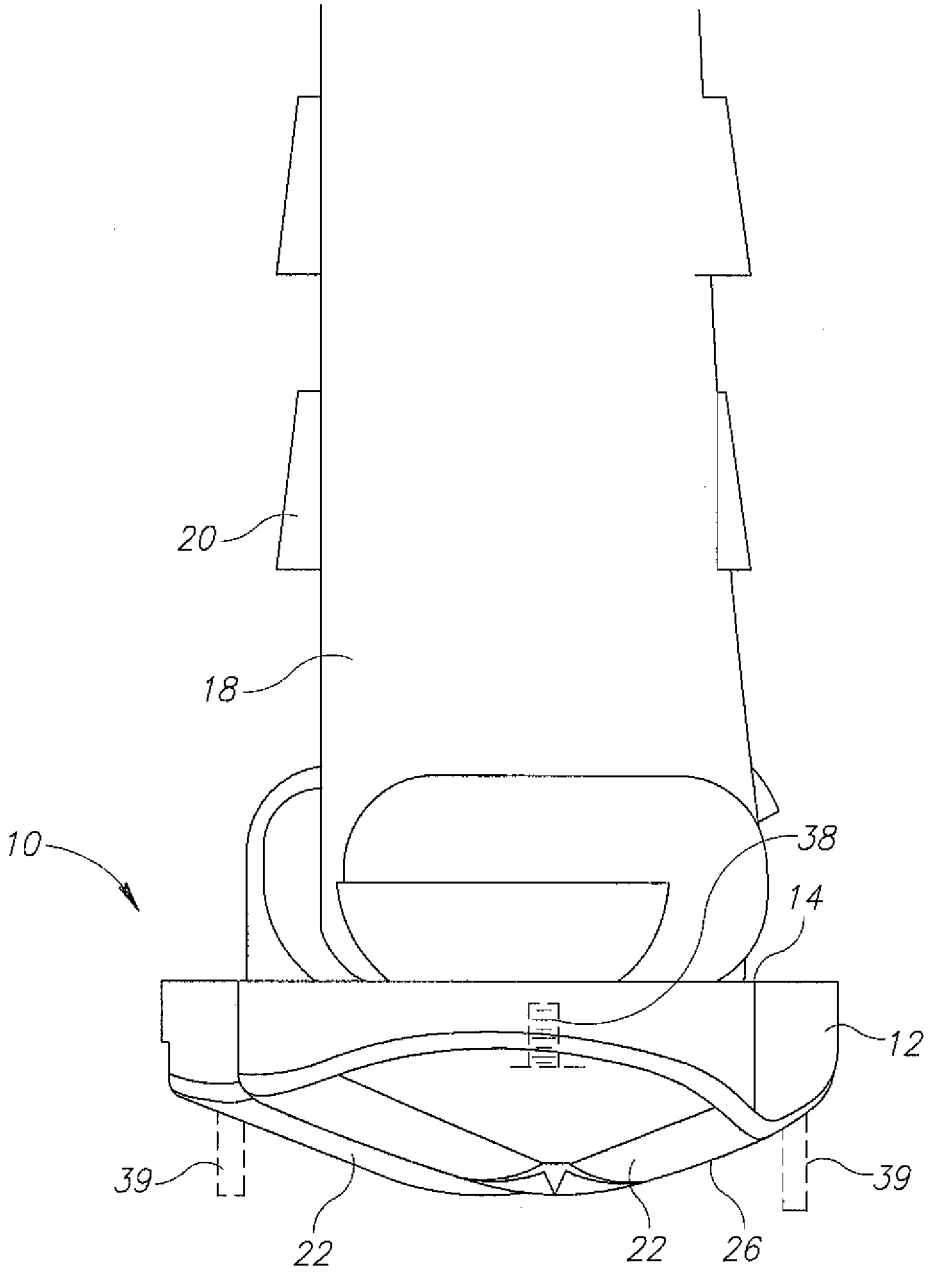

In accordance with an embodiment of the present invention, in addition to the bulbous protuberances 22, there further may be provided one or more non-bulbous protuberances 39, shown in FIG. 3. Protuberances 39 may be formed in the shape of a peg, stud, bolt, pin, dowel and the like, although the invention is not limited to these shapes. Protuberances 39 may be rigid or flexible. As with protuberances 22, the protuberances 39 may have different resilience or hardness, such as having different elasticity properties or Shore hardness, and they may protrude by different amounts from the lower surface 24 of support member 12. As above, the amount of protrusion of protuberances 39 may be adjusted. Protuberances 39 may be mounted at any place on the lower surface 24 of support member 12.

The features described above, such as the protuberances 22 being slidingly mounted on support member 12, may be implemented in the alternative embodiment wherein the bulbous protuberances 22 protrude from the upper surface 14 of support member 12. For example, footwear 10 may have a normal outer sole and have a sliding/shifting mechanism for the protuberances 22 inside the sole of footwear 10. The sliding/shifting mechanism may comprise, without limitation, a mechanism that floats in a viscous matrix (e.g., fluid in a chamber formed in the sole) or that is suspended by inner cables.

Reference is now made to FIG. 4. In accordance with an embodiment of the present invention, footwear 10 may comprise a flange 40 that extends outwards from the periphery of support member 12. In the illustrated embodiment, flange 40 extends sideways outwards from the periphery of support member 12, but it is appreciated that flange 40 may extend forwards or rearwards or in any other direction as well. Flange 40 may be provided on one side of footwear 10, as illustrated, or may be provided on both sides. Flange 40 may supplement the range of proprioceptive exercises possible with footwear 10, by providing an additional support surface during tilting and maneuvering with footwear 10.

Flange 40 may be constructed of any suitable material, such as but not limited to, elastomers or metal or a combination of materials, and may have portions 42 with different properties. For example, portions 42 may have different resilience or hardness, such as having different elasticity properties or Shore hardness. The portions 42 of flange 40 may have differently curved contours. Flange 40 may be adjustably attached to support member 12 such that the amount that flange 40 extends from support member 12 is adjustable.

A user may attach footwear 10 to his/her foot and perform a variety of maneuvers in a proprioceptive and/or kinesthetic exercise plan for the lower foot, upper leg and even upper torso 5 and other body parts and organs. For example, footwear 10 may be used to reestablish neuromuscular control during rehabilitation of joints, to restore the mechanical and functional stability of the neuromuscular system, to improve or rehabilitate anticipatory (feed-forward) and reflexive (feed-back) neuromuscular control mechanism, and to regain and improve balance, postural equilibrium and core stability.

Figure 5:
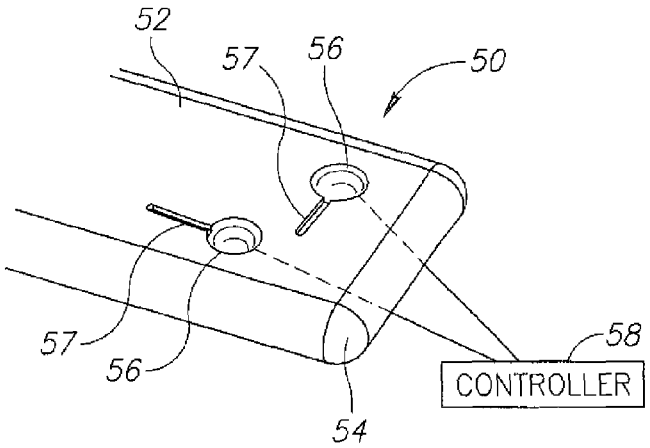
FIG. 5 is a simplified pictorial illustration of a treadmill constructed and operative in accordance with an embodiment of the present invention.

Reference is now made to FIG. 5, which illustrates a treadmill 50 constructed and operative in accordance with an embodiment of the present invention.

Treadmill 50 may comprise a foot-contact running surface 52 that rotates about a pair of spaced pulleys 54. Running surface 52 may comprise one or more protuberances 56 protruding upwards from running surface 52. Protuberances 56 may be of different or similar configuration (e.g., height, size, shape and/or slope). Protuberances 56 may have a fixed size/shape, or alternatively, may have a variable size/shape. The variable size/shape may be achieved by constructing protuberance 56 from an inflatable element, which may be inflated pneumatically with air or hydraulically with a liquid (e.g., water or oil). A controller 58 may be provided that controls inflation and deflation of protuberances 56. Protuberances 56 and/or running surface 52 may have different or similar material properties. For example, they may have different or similar resilience or viscosity (in the inflatable version) and may be made of different or similar materials.

Protuberances 56 may be movable. For example, one or more of the protuberances 56 may be translatable such as in a track 57 (e.g., forwards, backwards, sideways or diagonally) and/or rotatable about its own or other axis, or a combination of such motions. A protective strap (not shown) may be provided to maintain the user in an upright position and help prevent accidental falls.

Figure 6:
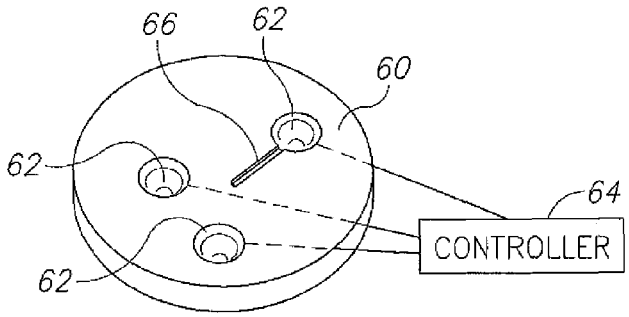
FIG. 6 is a simplified pictorial illustration of an exercise surface constructed and operative in accordance with an embodiment of the present invention.

Reference is now made to FIG. 6, which illustrates an exercise surface 60 constructed and operative in accordance with an embodiment of the present invention. Exercise surface 60 may comprise one or more protuberances 62 protruding upwards from the upper (foot-contacting) face and/or lower (floor-contacting) face of exercise surface 60. Protuberances 62 may be of different or similar configuration (e.g., height, size, shape and/or slope). Protuberances 62 may have a fixed size/shape, or alternatively, may have a variable size/shape. The variable size/shape may be achieved by constructing protuberance 62 from an inflatable element, which may be inflated pneumatically with air or hydraulically with a liquid (e.g., water or oil). A controller 64 may be provided that controls inflation and deflation of protuberances 62. Protuberances 62 may have different or similar resilience or viscosity (in the inflatable version), and may be made of different or similar materials.

Protuberances 62 may be movable. For example, one or more of the protuberances 62 may be translatable such as in a track 66 (e.g., forwards, backwards, sideways, radially or diagonally) and/or rotatable about its own or other axis, or a combination of such motions. A user of the exercise surface 60 may thus move in six degrees of freedom (translating in three mutually orthogonal directions (x, y, z) and rotating about these axes (azimuth, elevation and roll)).

Figure 7:
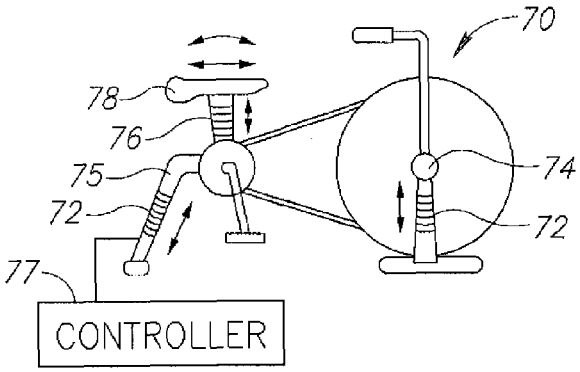
FIG. 7 is a simplified pictorial illustration of an exercise bicycle constructed and operative in accordance with an embodiment of the present invention.

Reference is now made to FIG. 7, which illustrates a stationary exercise bicycle 70 constructed and operative in accordance with an embodiment of the present invention. Exercise bicycle 70 may comprise apparatus with its own pedals, wheel and sensors (e.g., speedometer, odometer, etc.) or may comprise an indoor bicycle trainer, wherein a user mounts a bicycle to a stand, which permits pedaling the bicycle while the bicycle remains stationary. Exercise bicycle 70 may comprise a bumping mechanism 72 connected to a front axle 74 or rear support 75 of bicycle 70 and/or a bumping mechanism 76 connected to a seat 78 of bicycle 70. The bumping mechanisms may oscillate, rock, bump and otherwise disrupt the balance of the user of the exercise bicycle 70 (as indicated by arrows in FIG. 7). The bumping mechanisms may move the rider in six degrees of freedom (translation in three mutually orthogonal directions (x, y, z) and rotation about these axes (azimuth, elevation and roll)). The bumping mechanisms in this embodiment, as in other embodiments of the invention, may comprise a plate on which exercise bicycle 70 is mounted, wherein the plate provides the bumping action in six degrees of freedom.

Exercise bicycle 70 may be used to exercise the neuromuscular control in the back, hip, pelvis, ankle, knee and other parts of the body by means of bumps during riding, which may simulate riding on bumpy roads. A controller 77 may be provided to control operation of bumping mechanism 72.

Figure 8:
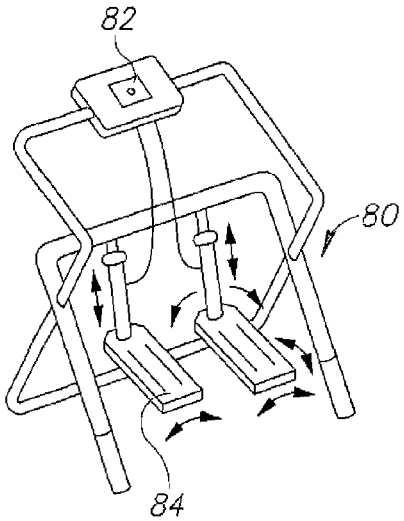
FIG. 8 is a simplified pictorial illustration of an exercise stepper constructed and operative in accordance with an embodiment of the present invention.

Reference is now made to FIG. 8, which illustrates an exercise stepper 80, constructed and operative in accordance with an embodiment of the present invention. Exercise stepper 80 may comprise a controller 82 that varies the resistive force offered by pedals 84 of the stepper 80. Controller 82 may also vary the angle of the pedals 84, such as to create eversion and inversion, as indicated by arrows in FIG. 8. Here too, controller 82 may move the pedals 84 in six degrees of freedom (translation in three mutually orthogonal directions (x, y, z) and rotation about these axes (azimuth, elevation and roll)).

Figure 9:
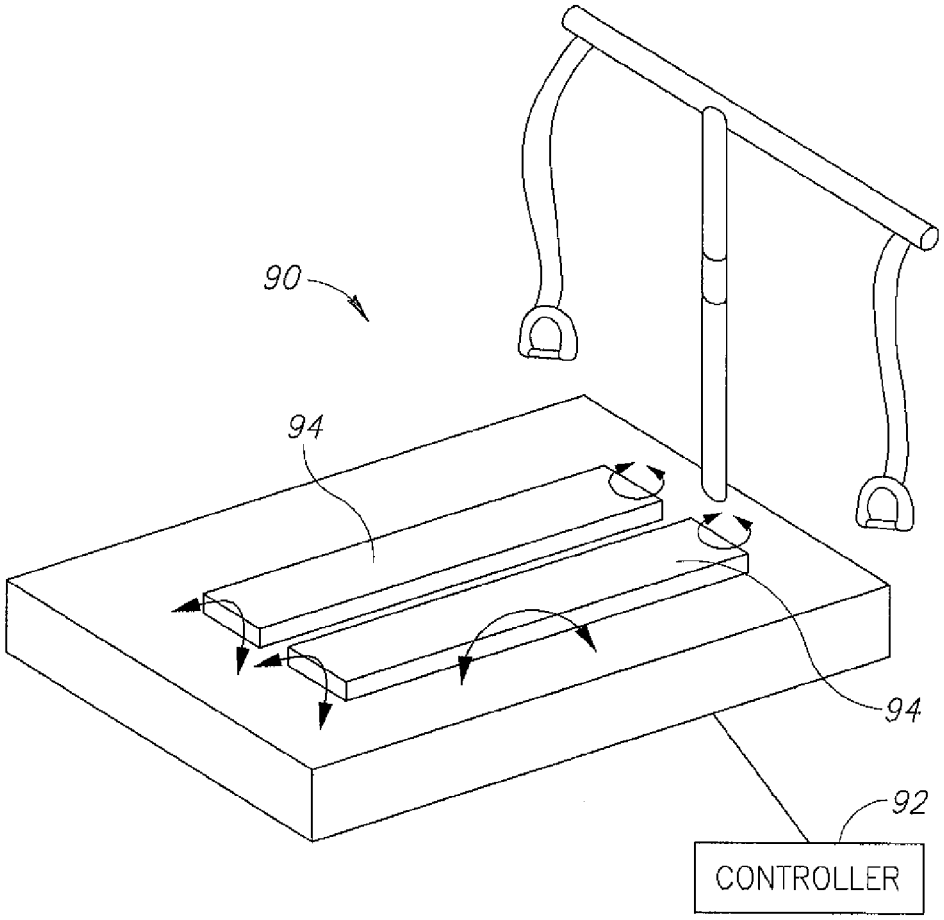
FIG. 9 is a simplified pictorial illustration of a ski machine constructed and operative in accordance with an embodiment of the present invention.

Reference is now made to FIG. 9, which illustrates a ski machine 90, constructed and operative in accordance with an embodiment of the present invention. Ski machine 90 may comprise a controller 92 that varies the resistive force offered by ski platforms 94 of the ski 90. Controller 92 may also vary the angle of ski platforms 94, such as to create eversion and inversion, as indicated by arrows in FIG. 9. Controller 92 may move the ski platforms 94 in six degrees of freedom (translation in three mutually orthogonal directions (x, y, z) and rotation about these axes (azimuth, elevation and roll)).

Some exercise experts have noted several drawbacks to prior art exercise equipment. For example, stationary exercise bicycles may utilize only a relatively small number of muscles, throughout a fairly limited range of motion. Cross-country skiing devices may exercise more muscles than a stationary bicycle, however, the substantially flat shuffling foot motion of the device may limit the range of motion of some of the muscles being exercised. Stair climbing devices may exercise more muscles than stationary bicycles, however, the limited range of up-and-down motion may not exercise the leg muscles through a large range of motion.

In response to these concerns, elliptic exercise machines have been developed that simulate natural walking and running motions and exercise a large number of muscles through a large range of motion. The machines provide variable, flexibly coordinated elliptical motion of the leg muscles. An example of one of the many elliptic exercise machines in the prior art is described in U.S. Pat. No. 5,848,954.

Figure 10:
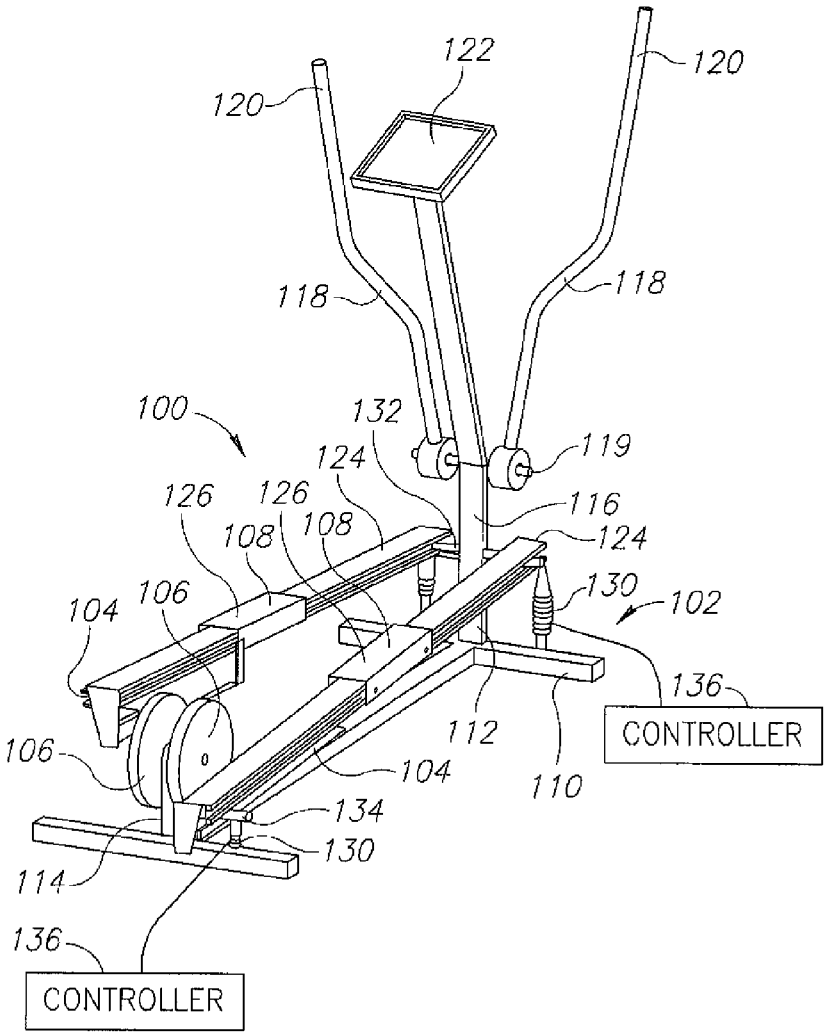
FIG. 10 is a simplified pictorial illustration of an elliptic exercise machine constructed and operative in accordance with an embodiment of the present invention.

Reference is now made to FIG. 10, which illustrates an elliptic exercise machine 100, constructed and operative in accordance with an embodiment of the present invention. Elliptic exercise machine 100 is shown for convenience with some elements similar to that of U.S. Pat. No. 5,848,954, but it is emphasized that the invention is not limited to this construction. In any case, the proprioceptive features of the invention are not found in U.S. Pat. No. 5,848,954 or any of the prior art.

Elliptic exercise machine 100 may comprise a frame 102 and a linkage assembly 104 movably mounted on frame 102. Linkage assembly 104 may generally move relative to frame 102 in a manner that links rotation of a flywheel 106 to generally elliptical motion of a force receiving member or "skate" 108. Frame 102 may include a base 110, a forward stanchion or upright 112, and a rearward stanchion or upright 114.

It is noted that the term "elliptical motion" is intended in a broad sense to describe a closed path of motion having a relatively longer first axis and a relatively shorter second axis (which extends perpendicular to the first axis). It is further noted that in the illustrated embodiment, there is left-right symmetry about a longitudinal axis, and the "right-hand" components are 180.degree out of phase relative to the "left-hand" components. However, like reference numerals are used to designate both the "right-hand" and "left-hand" parts on elliptic exercise machine 100, and when reference is made to one or more parts on only one side of the machine, it is to be understood that corresponding part(s) are disposed on the opposite side of the machine.

The forward stanchion 112 may extend perpendicularly upward from base 110 and support a telescoping tube or post 116. A pair of handles 118 may be pivotally mounted to post 116 at a pivot 119. Handles 118 may have gripping portions 120. A display 122 may be disposed on post 116. Skates 108 may slide on rails 124. A user may place his/her foot on a foot-contacting surface 126 of skate 108.

In accordance with an embodiment of the present invention, elliptic exercise machine 100 may comprise one or more bumping mechanisms 130 connected to a front support 132 and/or a rear support 134 of rails 124. The bumping mechanisms 130 may oscillate, rock, bump and otherwise disrupt the balance of the user of elliptic exercise machine 100. The bumping mechanisms 130 may move the user in six degrees of freedom (translation in three mutually orthogonal directions (x, y, z) and rotation about these axes (azimuth, elevation and roll)). A controller 136 may be provided to control operation of bumping mechanism 130.

Figure 11:
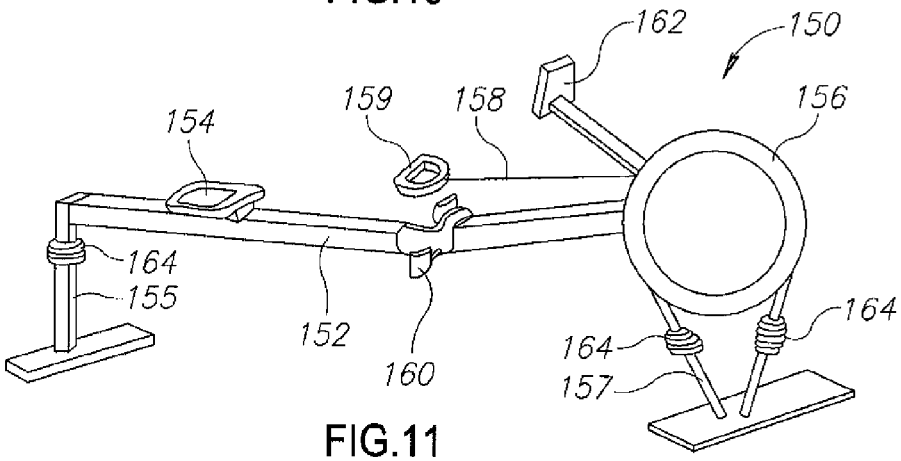
FIG. 11 is a simplified pictorial illustration of a rowing machine constructed and operative in accordance with an embodiment of the present invention.

Reference is now made to FIG. 11, which illustrates a rowing machine 150, constructed and operative in accordance with an embodiment of the present invention. Rowing machine 150 may comprise a rail 152 on which a seat 154 is slidingly mounted. Rail 152 may have a rear support 155. Rail 152 may extend from a forward-mounted tension drum 156, which may be mounted on a front support 157. A cord 158 may be wound around tension drum 156. Cord 158 may be provided with a handle 159. Footrests 160 may be mounted on rail 152.

A user (not shown) may sit on seat 154, place feet against the footrests 160, grasp handle 159 and pull cord 158 towards the rear of rowing machine 150, outwards from tension drum 156. This motion simulates the action of pulling oars in a rowboat. The seat 154 may slide back and forth on rail 152 during the rowing motion. Tension drum 156 resists the pulling action on cord 158, thereby exercising muscles used in rowing. The tension in tension drum 156 may be adjusted to suit the desired level of exercise. A controller 162 may be provided that varies the resistive force offered by tension drum 156.

In accordance with an embodiment of the present invention, rowing machine 150 may comprise one or more bumping mechanisms 164 connected to front support 157 and/or rear support 155 of rail 152, or to seat 154. The bumping mechanisms 164 may oscillate, rock, bump and otherwise disrupt the balance of the user of rowing machine 150. The bumping mechanisms 164 may move the user in six degrees of freedom (translation in three mutually orthogonal directions (x, y, z) and rotation about these axes (azimuth, elevation and roll)). Controller 162 may control operation of bumping mechanisms 164.

In some embodiments of the present invention, at least two bulbous protuberances 22 protrude from a lower surface 24 of support member 12. In some embodiments of the present invention, only two bulbous protuberances 22 protrude from a lower surface 24 of support member 12. In some embodiments of the present invention, a lower surface of support member is an outsole. In some embodiments of the present invention, only two bulbous protuberances 22 protrude from a lower surface 24 of support member 12. In some embodiments of the present invention, the ground engaging parts of the device are only the bulbous protuberances 22. In some embodiments of the present invention, during all phases of gait including the stance phase the bulbous protuberances 22 are the only parts of the device which are ground engaging. In some embodiments of the present invention, during all phases of gait including the stance phase the bulbous protuberances 22 are the only parts of the device which are in direct contact with the ground.

In another embodiment, protuberances as described herein are not pegs. In another embodiment, each shoe of the footwear of the invention comprises two bulbous protuberances. In another embodiment, each shoe of the footwear of the invention consists two bulbous protuberances. In another embodiment, each shoe of the footwear of the invention consists two bulbous protuberances and optionally spacers/weights places in between a protuberance's base and the outer-sole.

In another embodiment, the invention provides that the device such as footwear 10 supports the foot of a subject only by the two protuberances when the two protuberances are placed on a ground surface. In another embodiment, the invention provides that the device such as footwear 10 supports the foot of a subject during stance by only two protuberances when the two protuberances are placed on a ground surface. In another embodiment, the invention provides that during stance only the 2 ground engaging surfaces of the protuberances (such as the peak or the surface facing the ground) are in contact with a ground surface. In another embodiment, the invention provides that during stance only the ground engaging surface in each protuberance is in contact with a ground surface. Each possibility represents a separate embodiment of the present invention.

In another embodiment, at least two bulbous protuberances 22 protrude from a lower surface 24 of support member 12. In another embodiment, only two bulbous protuberances 22 protrude from a lower surface 24 of support member 12.

In another embodiment, the outer sole is a surface having no openings or apertures adapted to receive additional protuberances other than the two bulbous protuberances 22. In another embodiment, the outer sole is a surface having no protrusions other than the two bulbous protuberances 22.

In some embodiments of the present invention, a protuberance as described herein is movable. In some embodiments of the present invention, a protuberance as described herein is mountable. In some embodiments of the present invention, a protuberance as described herein is replaceable. In some embodiments of the present invention, a protuberance as described herein is movable along the outer surface of the support member. In some embodiments of the present invention, a protuberance as described herein is movable along the outer surface of the outsole. In some embodiments of the present invention, a protuberance as described herein can be positioned within the outer surface of the support member.

In some embodiments of the present invention a protuberance is fixed in a predetermined location. In some embodiments of the present invention, a protuberance is movable within a predefined area. In some embodiments of the present invention, a protuberance is movable within an area of 1 cm2 to 18 cm2. In some embodiments of the present invention, a protuberance is movable within an area of 1 cm2 to 6 cm2. In some embodiments of the present 20 invention, a protuberance is movable within an area of 1 cm2 to 4 cm2. In some embodiments of the present invention, a protuberance is movable within an area of 2 cm2 to 8 cm2. In some embodiments of the present invention, a protuberance is movable within an area of 3 cm2 to 6 cm2. In some embodiments of the present invention, a protuberance is movable within an area of 4 cm2 to 10 cm2. In some embodiments of the present invention, a protuberance is movable within an area of 5 cm2 to 18 cm2. In some embodiments of the present invention, a protuberance is movable within an area of 4 cm2 to 12 cm2.

In some embodiments of the present invention, the predefined area within which the protuberance is movable is a circle. In other embodiments, a predefined area within which the protuberance is movable is a square. In other embodiments, a predefined area within which the protuberance is movable is an ellipse. In other embodiments, a predefined area within which the protuberance is movable is a rectangle. In other embodiments, a predefined area within which the protuberance is movable is quadrangular.

In some embodiments, the protuberance is hooked to a rail. In some embodiments, the protuberance is connected to a rail. In some embodiments, the protuberance is connected to a rail and is movable along the rail. In some embodiments, the protuberance is connected to a rail, is movable along the rail, and can be positioned and/or fixed anywhere along the rail.

[In another embodiment, a protuberance can be fixed anywhere on the support member. In another embodiment, a protuberance can be positioned and/or fixed anywhere within a predefined area.

In another embodiment, the device comprises at least one anterior protuberance and one moveable/relocatable posterior protuberance. In another embodiment, the device comprises at least one moveable/relocatable anterior protuberance and one posterior protuberance. In another embodiment, the device comprises one moveable/relocatable anterior protuberance and one moveable/relocatable posterior protuberance. In another embodiment, the device consists one moveable/relocatable anterior protuberance and one moveable/relocatable posterior protuberance. Each possibility represents a separate embodiment of the present invention. In another embodiment, the term "comprises" may include the term "consists".

As seen clearly in FIG. 2, one protuberance 22 may be positioned more posteriorly than the other protuberance 22. In some embodiments, a device as described herein comprises at least one anterior bulbous protuberance. In other embodiments, a device as described herein comprises at least one posterior bulbous protuberance. In other embodiments, the device includes one anterior bulbous protuberance and one posterior bulbous protuberance. In other embodiments, the device comprises at least one anterior bulbous protuberance and one moveable posterior bulbous protuberance. In other embodiments, the device comprises at least one moveable anterior bulbous protuberance and one posterior bulbous protuberance. In other embodiments, the device comprises at least one moveable anterior bulbous protuberance and one moveable posterior bulbous protuberance. In other embodiments, the device includes one moveable anterior bulbous protuberance and one moveable posterior bulbous protuberance.

The longitudinal centerline is defined, in some embodiments, as a longitudinal straight line connecting middles of the short sides of a rectangle which delimits a contour of the support member. The contour of the support member is defined, in some embodiments, as a foothold confined by an upper part of the footwear. The contour of the support member is defined, in some embodiments, as an outermost contour of the footwear. The contour of the support member is defined, in some embodiments, as a contour of a bottom surface of a sole of the footwear.

In some embodiments, the protuberances rise vertically, each protuberance including a base end and a peak end. In some embodiments, the surface area of the base is larger than the surface area of the peak. In some embodiments, the peak is the ground engaging portion of a protuberance.

In some embodiments, bulbous protuberance 22 protrudes from the upper surface 14 of support member 12. In some embodiments, each protuberance 22 has a curved outer contour 26. In some embodiments, each protuberance 22 has a different curved outer contour. In some embodiments, each protuberance 22 has a convexity. In some embodiments, each protuberance 22 has a different convexity. The cross-section of the contour 26, that is, either the cross-section taken with respect to a longitudinal axis 28 (FIG. 4) of support member 12 (corresponding to the shape seen in FIG. 2) or the cross-section taken with respect to a latitudinal axis 30 (FIG. 4) of support member 12 (corresponding to the shape seen in FIG. 3), or any other cross-section, may have any curvilinear shape. In some embodiments, the contours 26 may have the shape of a conic section, that is, the shape of a circle, ellipse, parabola or hyperbola. The various cross-sections of the contours 26 of protuberance 22 may be shaped identically or differently.

In some embodiments, as seen in FIG. 4, the protuberances are positioned on a common longitudinal axis of support member 12, such as the centerline 28 of support member 12. In some embodiments, the protuberances are positioned on opposite sides of the latitudinal midline 30. In some embodiments, the protuberances are positioned offset from the centerline 28 of support member 12, and on opposite sides of the latitudinal midline 30. In some embodiments, the meaning of "protuberance is positioned offset from the centerline" comprises that the peak or the ground engaging surface of a protuberances is positioned offset from the centerline. In some embodiments, the meaning of "protuberance is positioned offset from the centerline" comprises that only the peak or the ground engaging surface of a protuberances is positioned offset from the centerline but the centerline still crosses the protuberance. In some embodiments, the bases of the protuberances are positioned on the centerline of the support member. In some embodiments, the peaks of the protuberances are positioned on opposite sides of the centerline of support member. In some embodiments, the centerline divides longitudinally the calcaneus support portion into two equal halves and further extends towards the phalanges and metatarsals support portion in a straight line. In some embodiments, the centerline divides longitudinally the arch of the calcaneus support portion into two equal halves and further extends towards the phalanges and metatarsals support portion in a straight line. In some embodiments, the centerline divides longitudinally the proximal arch of the calcaneus support portion into two equal halves and further extends towards the phalanges and metatarsals support portion in a straight line. In some embodiments, the centerline divides longitudinally the support portion as seen in FIG. 4 of the calcaneus support portion into two equal halves and further extends towards the phalanges and metatarsals support portion in a straight line.

In some embodiments, the bases of the protuberances are positioned on the centerline of the support member and the peaks of the protuberances are positioned on opposite sides of the centerline of support member. In some embodiments, the bases of the protuberances are positioned on the centerline of the support member but the peaks of the protuberances are offset from the centerline of the support member. In some embodiments, the bases of the protuberances are positioned on the centerline of the support member but the peaks of the protuberances are positioned on opposite sides of the centerline of the support member.

In some embodiments, the anterior protuberance is positioned medially from the centerline of the support member. In some embodiments, the peak of the anterior protuberance is positioned medially from the centerline of the support member. In some embodiments, the base of the anterior protuberance is position on the centerline of the support member but the peak of the anterior protuberance is positioned medially from the centerline of the support member. In some embodiments, the anterior protuberance is positioned laterally from the centerline of the support member. In some embodiments, the peak of the anterior protuberance is positioned laterally from the centerline of the support member. In some embodiments, the base of the anterior protuberance is position on the centerline of the support member but the peak of the anterior protuberance is positioned laterally from the centerline of the support member. In some embodiments, the posterior protuberance is positioned medially from the centerline of the support member. In some embodiments, the peak of the posterior protuberance is positioned medially from the centerline of the support member. In some embodiments, the base of the posterior protuberance is positioned on the centerline of the support member but the peak of the posterior protuberance is positioned medially from the centerline of the support member. In some embodiments, the posterior protuberance is positioned laterally from the centerline of the support member. In some embodiments, the peak of the posterior protuberance is positioned laterally from the centerline of the support member. In some embodiments, the base of the posterior protuberance is position on the centerline of the support member but the peak of the posterior protuberance is positioned laterally from the centerline of the support member.

In some embodiments, the term sneaker comprises a boot. In some embodiments, the term sneaker comprises a walking boot. In some embodiments, sneaker comprises a platform of a running shoe.

In some embodiments, the ground engaging parts of the device are only the protuberances. In some embodiments, during all phases of gait including the stance phase the protuberances are the only parts of the device which are ground engaging. In some embodiments, during the stance phase the protuberances are the only parts of the device which are ground engaging. Each possibility represents a separate embodiment of the present invention.

In some embodiments, a protuberance is movable within a predefined area. In some embodiments, a protuberance is movable within an area of 1 cm2 to 18 cm2. In some embodiments, a protuberance is movable within an area of 1 cm2 to 6 cm2. In some embodiments, a protuberance is movable within an area of 1 cm2 to 4 cm2. In some embodiments, a protuberance is movable within an area of 2 cm2 to 8 cm2. In some embodiments, a protuberance is movable within an area of 3 cm2 to 6 cm2. In some embodiments, a protuberance is movable within an area of 4 cm2 to 10 cm2. In some embodiments, a protuberance is movable within an area of 5 cm2 to 18 cm2. In some embodiments, a protuberance is movable within an area of 4 cm2 to 12 cm2. Each possibility represents a separate embodiment of the present invention.

In some embodiments, the footwear 10 comprises a support member 12 having a periphery in a shape of a shoe sole with an upper surface 14. In some embodiments, the footwear 10 comprises an insole placed on top of the upper surface 14. In some embodiments, the insole is the interior bottom of footwear 10. In some embodiments, the insole sits directly beneath the foot. In some embodiments, the insole is removable, replaceable, or both. In some embodiments, the insole adds comfort, control the shape, moisture, smell, or any combination thereof. In some embodiments, the insole is placed to correct defects in the natural shape of the foot or positioning of the foot during standing or walking. Each possibility represents a separate embodiment of the present invention.

In some embodiments, the peak or the ground engaging surface of the anterior protuberance is positioned laterally from the centerline of the support member. In some embodiments, the peak or the ground engaging surface of the anterior protuberance is positioned medially from the centerline of the support member. In some embodiments, the peak or the ground engaging surface of the anterior protuberance is positioned laterally from the centerline of the support member and the peak or the ground engaging surface of the posterior protuberance is aligned with centerline. In some embodiments, the peak or the ground engaging surface of the anterior protuberance is positioned medially from the centerline of the support member and the peak or the ground engaging surface of the posterior protuberance is aligned with centerline. Each possibility represents a separate embodiment of the present invention.

In some embodiments, the peak or the ground engaging surface of the posterior protuberance is positioned laterally from the centerline of the support member. In some embodiments, the peak or the ground engaging surface of the posterior protuberance is positioned medially from the centerline of the support member. In some embodiments, the peak or the ground engaging surface of the posterior protuberance is positioned laterally from the centerline of the support member and the peak or the ground engaging surface of the anterior protuberance is aligned with centerline. In some embodiments, the peak or the ground engaging surface of the posterior protuberance is positioned medially from the centerline of the support member and the peak or the ground engaging surface of the anterior protuberance is aligned with centerline. Each possibility represents a separate embodiment of the present invention.

In some embodiments, the peak or the ground engaging surface of the posterior protuberance is positioned laterally from the centerline of the support member and the peak or the ground engaging surface of the anterior protuberance is positioned medially from the centerline of the support member. In some embodiments, the peak or the ground engaging surface of the anterior protuberance is positioned laterally from the centerline of the support member and the peak or the ground engaging surface of the posterior protuberance is positioned medially from the centerline of the support member. Each possibility represents a separate embodiment of the present invention.

In some embodiments, protuberances are of different heights. In some embodiments, protuberances are of different weights. In some embodiments, a footwear of the invention further comprises a spacer located between the base of a protuberance and the support member or outsole. In some embodiments, a spacer is used for adjusting the height of a protuberance, the weight of a protuberance or a combination thereof.

In some embodiments, a spacer or a protuberance comprises a diameter of 50-150 mm. In some embodiments, a spacer or a protuberance comprises a diameter of 55-110 mm. In some embodiments, a spacer or a protuberance comprises a diameter of 60-100 mm. In some embodiments, a spacer or a protuberance comprises a diameter of 80-90 mm. In some embodiments, a spacer or a protuberance comprises a diameter of 85 mm. In some embodiments, a spacer or a protuberance or a protuberance comprises a thickness of 1-12 mm. In some embodiments, a spacer or a protuberance comprises a thickness of 1-4 mm. In some embodiments, a spacer or a protuberance comprises a thickness of 3-10 mm. In some embodiments, a spacer or a protuberance comprises a thickness of 1-3 mm.

In some embodiments, a spacer or a protuberance comprises hardness of 35-100 Sh A. In some embodiments, a spacer or a protuberance comprises hardness of 60-70 Shore A, which is a soft spacer. In some embodiments, a spacer or a protuberance comprises hardness of 90-100 Shore A, which is a hard spacer. In some embodiments, a spacer or a protuberance comprises hardness of 70-90 Shore A, which is medium hardness spacer. In another embodiment, the protuberance's range of hardness as provided herein reflects an effective range that allows minimal deformation of the protuberance's structure/shape/contour. In another embodiment, the protuberance's range of hardness reflects an effective range that abolishes or minimizes bouncing. In another embodiment, the protuberance's range of hardness reflects an effective range that abolishes or minimizes spring characteristics. In another embodiment, the protuberance's range of hardness reflects an effective range that allows optimal and/or minimizes bouncing. In another embodiment, the protuberance's range of hardness enables the control of ground reaction force. In another embodiment, the protuberance's range of hardness enables the control of ground reaction force which is important for treating osteoarthritis. In another embodiment, the protuberance's range of hardness enables the control of ground reaction force which is important for treating knee pathologies such as knee osteoarthritis. In another embodiment, a hard protuberance focuses, concentrates and/or enhances loads exerted on it while a soft protuberance allows the migration of loads. In another embodiment, a "hard" protuberance has shore hardness in the upper 40% of the range of shore hardness provided herein. In another embodiment, a "soft" protuberance has shore hardness in the lower 40% of the range of shore hardness provided herein.

In another embodiment, the harder the protuberance is, the vectorial shift of loads exerted by the user on the protuberance during gait, is more precise with respect to [targeted] body part. In another embodiment, a hard protuberance minimizes deformation of the protuberance upon impact with the ground, especially in the area contacting the ground. In another embodiment, the softer protuberance reduces the impact resulting from ground engagement. In another embodiment, the soft protuberance has better shock absorbing properties than the hard protuberance and is suited for the treatment of pain in the lower limbs and/or lower back.

In another embodiment, a protuberance is a soft protuberance comprising a shore hardness of between 40 to 55 Sh A. In another embodiment, a protuberance is a medium hardness protuberance comprising a shore hardness of between 50 to 70 Sh A. In another embodiment, a protuberance is a hard protuberance comprising a shore hardness of between 65 to 90 Sh A.

In some embodiments, a spacer or a protuberance weighs 2-500 g. In some embodiments, a spacer or a protuberance weighs 2-250 g. In some embodiments, a spacer or a protuberance weighs 2-6 g. In some embodiments, a spacer or a protuberance weighs 2-20 g. In some embodiments, a spacer or a protuberance weighs 2-20 g is made of Nylon. In some 15 embodiments, a spacer or a protuberance weighs 2-20 g is made of Nylon and fiber. In some embodiments, a spacer or a protuberance weighs 2-40 g is made of Nylon and glass fiber. In some embodiments, a spacer or a protuberance weighs 30-100 g. In some embodiments, a spacer or a protuberance weighs 50-80 g. In some embodiments, a spacer or a protuberance weighs 60-100 g. In some embodiments, a spacer or a protuberance comprises: Nylon glass fiber polyurethane an alloy (such as but not limited to Zink alloy), or any combination thereof. Each possibility represents a separate embodiment of the present invention.

In another embodiment, the ratio between the surface area of the inner sole (the surface are facing the user's foot or the surface area adapted to contact the user's foot) to the combined surface area of the bases of the two bulbous protuberances is 7:1 to 1:0.8. In another embodiment, the ratio between the surface area of the inner sole to the combined surface area of the bases of the two bulbous protuberances is 5:1 to 1:1. In another embodiment, the ratio between the surface area of the inner sole to the combined surface area of the bases of the two bulbous protuberances is 4:1 to 1:1. In another embodiment, the ratio between the surface area of the inner sole to the combined 5 surface area of the bases of the two bulbous protuberances is 6:1 to 2:1. In another embodiment, the ratio between the surface area of the inner sole to the combined surface area of the bases of the two bulbous protuberances is 8:1 to 1:1. In another embodiment, the ratio between the surface area of the inner sole to the combined surface area of the bases of the two bulbous protuberances is 6:1 to 1:1.5. In another embodiment, the ratio between the surface area of the inner sole to the combined surface area of the bases of the two bulbous protuberances is 8:1 to 3:1.

In another embodiment, the ratio between the surface area of the inner sole (the surface is facing the user's foot or the surface area adapted to contact the user's foot) to the surface area of a base of at least one bulbous protuberance of the two bulbous protuberances is 20:1 to 4:1. In another embodiment, the ratio between the surface area of the inner sole to the surface area of a base of at least one bulbous protuberance of the two bulbous protuberances is 15:1 to 3:1. In another embodiment, the ratio between the surface area of the inner sole to the surface area of a base of at least one bulbous protuberance of the two bulbous protuberances is 12:1 to 5:1. In another embodiment, the ratio between the surface area of the inner sole to the surface area of a base of at least one bulbous protuberance of the two bulbous protuberances is 8:1 to 3:1. In another embodiment, the ratio between the surface area of the inner sole to the surface area of a base of at least one bulbous protuberance of the two bulbous protuberances is 6:1 to 2:1. In another embodiment, the ratio between the surface area of the inner sole to the surface area of a base of at least one bulbous protuberance of the two bulbous protuberances is less than 20:1. In another embodiment, the ratio between the surface area of the inner sole to the surface area of a base of at least one bulbous protuberance of the two bulbous protuberances is less than 15:1. In another embodiment, the ratio between the surface area of the inner sole to the surface area of a base of at least one bulbous protuberance of the two bulbous protuberances is less than 12:1. In another embodiment, the ratio between the surface area of the inner sole to the surface area of a base of at least one bulbous protuberance of the two bulbous protuberances is less than 10:1. In another embodiment, the ratio between the surface area of the inner sole to the surface area of a base of at least one bulbous protuberance of the two bulbous protuberances is less than 8:1. In another embodiment, the ratio between the surface area of the inner sole to the surface area of a base of at least one bulbous protuberance of the two bulbous protuberances is less than 7:1. In another embodiment, the ratio between the surface area of the inner sole to the surface area of a base of at least one bulbous protuberance of the two bulbous protuberances is less than 6:1. In another embodiment, the ratio between the surface area of the inner sole to the surface area of a base of at least one bulbous protuberance of the two bulbous protuberances is less than 5:1. In another embodiment, the ratio between the surface area of the inner sole to the surface area of a base of at least one bulbous protuberance of the two bulbous protuberances is less than 4:1.

In another embodiment, the ratio between the surface area of the inner sole to the surface area of a base of at least one bulbous protuberance of the two bulbous protuberances is more than 1:1. In another embodiment, the ratio between the surface area of the inner sole to the surface area of a base of at least one bulbous protuberance of the two bulbous protuberances is more than 1.5:1. In another embodiment, the ratio between the surface area of the inner sole to the surface area of a base of at least one bulbous protuberance of the two bulbous protuberances is more than 2:1. In another embodiment, the ratio between the surface area of the inner sole to the surface area of a base of at least one bulbous protuberance of the two bulbous protuberances is more than 3:1.

In another embodiment, the ratio between the surface area of the outer sole (the surface are facing the ground) to the combined surface area of the bases of the two bulbous protuberances is 20:1 to 4:1. In another embodiment, the ratio between the surface area of the outer sole to the combined surface area of the bases of the two bulbous protuberances is 1:16 to 1:10. In another embodiment, the ratio between the surface area of the outer sole to the combined surface area of the bases of the two bulbous protuberances is 15:1 to 5:1. In another embodiment, the ratio between the surface area of the outer sole to the combined surface area of the bases of the two bulbous protuberances is 10:1 to 3:1. In another embodiment, the ratio between the surface area of the outer sole to the combined surface area of the bases of the two bulbous protuberances is 8:1 to 1:1. In another embodiment, the ratio between the surface area of the outer sole to the combined surface area of the bases of the two bulbous protuberances is 12:1 to 7:1.

In another embodiment, the ratio between the surface area of the outer sole (the surface are facing the ground) to the surface area of a base of at least one bulbous protuberance of the two bulbous protuberances is 40:1 to 18:1. In another embodiment, the ratio between the surface area of the outer sole to the surface area of a base of at least one bulbous protuberance of the two bulbous protuberances is at least 10:1. In another embodiment, the ratio between the surface area of the outer sole to the surface area of a base of at least one bulbous protuberance of the two bulbous protuberances is at least 20:1.

In another embodiment, the ratio between the minimal width of the inner sole to the minimal diameter of the base of at least one bulbous protuberance of the two bulbous protuberances is 2:1 to 1:1.5. In another embodiment, the ratio between the minimal width of the inner sole to the minimal diameter of the base of at least one bulbous protuberance of the two bulbous protuberances is 1:0.8 to 1:1.2. In another embodiment, the ratio between the minimal width of the inner sole to the minimal diameter of the base of at least one bulbous protuberance of the two bulbous protuberances is at least 1:0.4. In another embodiment, the ratio between the minimal width of the inner sole to the minimal diameter of the base of at least one bulbous protuberance of the two bulbous protuberances is at least 1:0.6. In another embodiment, the ratio between the minimal width of the inner sole to the minimal diameter of the base of at least one bulbous protuberance of the two bulbous protuberances is less than 1:1.8. In another embodiment, the ratio between the minimal width of the inner sole to the minimal diameter of the base of at least one bulbous protuberance of the two bulbous protuberances is less than 1:1.5.

In another embodiment, the ratio between the maximal width of the inner sole to the minimal diameter of the base of at least one bulbous protuberance of the two bulbous protuberances is 5:1 to 1:1. In another embodiment, the ratio between the maximal width of the 10 inner sole to the minimal diameter of the base of at least one bulbous protuberance of the two bulbous protuberances is 4:1 to 1:1. In another embodiment, the ratio between the maximal width of the inner sole to the minimal diameter of the base of at least one bulbous protuberance of the two bulbous protuberances is less than 8:1. In another embodiment, the ratio between the maximal width of the inner sole to the minimal diameter of the base of at least one bulbous protuberance of the two bulbous protuberances is less than 6:1. In another embodiment, the ratio between the maximal width of the inner sole to the minimal diameter of the base of at least one bulbous protuberance of the two bulbous protuberances is less than 4:1.

In another embodiment, the ratio between the maximal width of the inner sole to the maximal diameter of the base of at least one bulbous protuberance of the two bulbous protuberances is 2:1 to 1:2. In another embodiment, the ratio between the maximal width of the inner sole to the maximal diameter of the base of at least one bulbous protuberance of the two bulbous protuberances is 1:0.8 to 1:1.2. In another embodiment, the ratio between the maximal width of the inner sole to the maximal diameter of the base of at least one bulbous protuberance of the two bulbous protuberances is at least 1:0.4. In another embodiment, the ratio between the maximal width of the inner sole to the maximal diameter of the base of at least one bulbous protuberance of the two bulbous protuberances is at least 1:0.6. In another embodiment, the ratio between the maximal width of the inner sole to the maximal diameter of the base of at least one bulbous protuberance of the two bulbous protuberances is less than 1:1.8. In another embodiment, the ratio between the maximal width of the inner sole to the maximal diameter of the base of at least one bulbous protuberance of the two bulbous protuberances is less than 1:1.5.

In another embodiment, the ratio between the minimal width of the outer sole to the minimal diameter of the base of at least one bulbous protuberance of the two bulbous protuberances is 2:1 to 1:1.5. In another embodiment, the ratio between the minimal width of the outer sole to the minimal diameter of the base of at least one bulbous protuberance of the two bulbous protuberances is 1:0.8 to 1:1.2. In another embodiment, the ratio between the minimal width of the outer sole to the minimal diameter of the base of at least one bulbous protuberance of the two bulbous protuberances is at least 1:0.4. In another embodiment, the ratio between the minimal width of the outer sole to the minimal diameter of the base of at least one bulbous protuberance of the two bulbous protuberances is at least 1:0.6. In another embodiment, the ratio between the minimal width of the outer sole to the minimal diameter of the base of at least one bulbous protuberance of the two bulbous protuberances is less than 1:1.8. In another embodiment, the ratio between the minimal width of the outer sole to the minimal diameter of the base of at least one bulbous protuberance of the two bulbous protuberances is less than 1:1.5.

In another embodiment, an area of a base of a protuberance as described herein maximizes support to the user's foot. In another embodiment, the combined areas of the bases of the two protuberances enable the two protuberances, alone, as described herein to support a user.

In some embodiments, a protuberance is compressible. In some embodiments, a protuberance is shock absorbing. In some embodiments, a protuberance is deformable. In some embodiments, a protuberance is compressible or deformable upon pressure exerted by subject's weight. Each possibility represents a separate embodiment of the present invention.

In some embodiments, a protuberance is made of a shock absorbing material. In some embodiments, a protuberance is made of rubber. In another embodiment, a protuberance is composed of at least one elastomer. In some embodiments, a protuberance is made of an elastic material. In some embodiments, a protuberance is made of a continuous elastic material. In some embodiments, a protuberance is made of a "non-hookean" material. In some embodiments, the elasticity of a protuberance is stress dependent. In some embodiments, a protuberance is composed of a material that is sensitive to temperature and loading rate. In some embodiments, a protuberance is not a spring. In another embodiment, a protuberance is devoid of a spring. In another embodiment, a protuberance is devoid of a spring. In another embodiment, a protuberance does not have high yield strength and therefore cannot return to its original shape upon significant bending or twisting. In another embodiment, a protuberance is made of a material that does not exert force that is disproportional to its change in length.

In another embodiment, a protuberance has a measure of less than 10 Young's modulus in GPa. In another embodiment, a protuberance has a measure of less than 7.5 Young's modulus in GPa. In another embodiment, a protuberance has a measure of less than 5 Young's modulus in GPa. In another embodiment, a protuberance has a measure of 0.01 to 7.5 Young's modulus in GPa. In another embodiment, a protuberance has a measure of 0.01 to 5 Young's modulus in GPa.

In another embodiment, a protuberance has a density in g/cm3 of less than 2. In another embodiment, a protuberance has a density in g/cm3 of less than 1.8. In another embodiment, a protuberance has a density in g/cm3 of 0.5 to 2. In another embodiment, a protuberance has a density in g/cm3 of 0.7 to 1.8. In another embodiment, a protuberance has a density in g/cm3 of 0.7 to 1.5. In another embodiment, a protuberance has an elastic limit of 200% (stretched 200% and returned to original shape). In another embodiment, a protuberance has an elastic limit of 180%. In another embodiment, a protuberance has an elastic limit of 150%. In another embodiment, a protuberance has an elastic limit of 125%.

In some embodiments, a protuberance has a convexity defined as follows (see FIG. 19): A cross section of the curvature of the protuberance, from a circumference thereof to an apex thereof, may be delimited between graphs of the following two functions:

$$f(x) = \sqrt[8]{5x} \tag{1}$$

$$f(x) = \sqrt[3]{\frac{1}{3}x^2} \tag{2}$$

Figure 19:
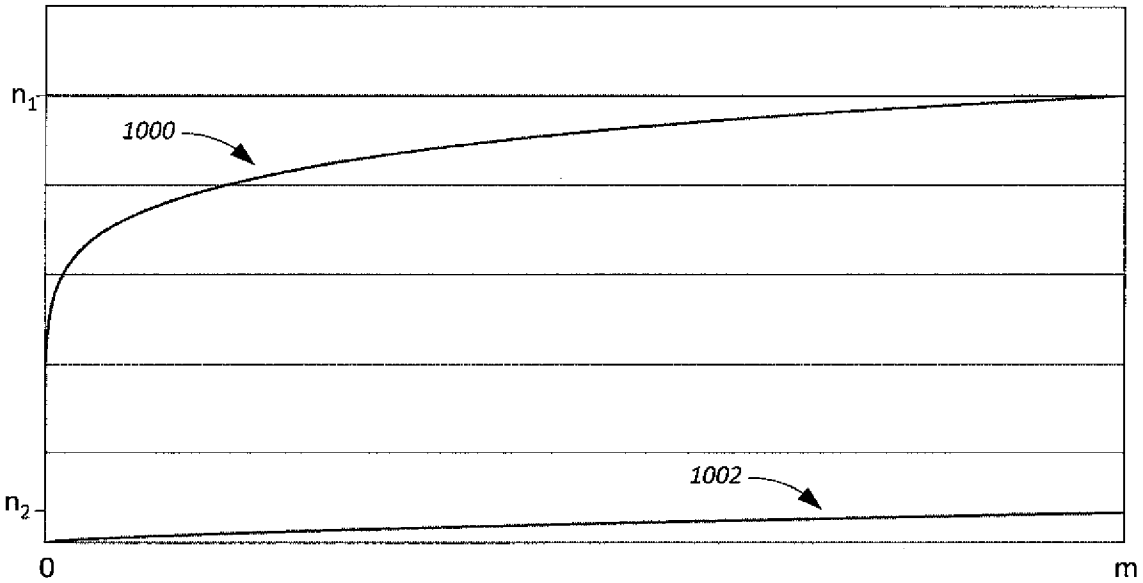
FIG. 19 are graphs defining the convexity of a protuberance suitable for use on a footwear, according to embodiments of the present invention. First graph 1000 illustrates function $f(x)=\sqrt{(8\&5x)}$ (1) and second graph 1002 illustrates function $f(x)=\sqrt[3]{(1/3\,x\hat{}2)}$ (2). The circumference of the protuberance is at x, y=0 for both functions. The apex of the protuberance is at x=m for both functions, whereas the y-axis value of the apex may be between n1 for function (1) and n2 for function (2).

Reference is now made to FIG. 19, which shows a first graph 1000 illustrating function (1) and a second graph 1002 illustrating function (2). The circumference of the protuberance is at x, y=0 for both functions. The apex of the protuberance is at x=m for both functions, whereas the y-axis value of the apex may be between n1 for function (1) and n2 for function (2). The apex of the protuberance is its highest point relative to its circumference. The apex may be at a horizontal center of the curvature, or be offset from that horizontal center. As an alternative to a single point, the apex may span over a flat, horizontal area.

In another embodiment, the cross section of the curvature of the protuberance may be continuous or comprised of discrete segments. In another embodiment, the protuberance may be separated (fully or partially) into numerous bodies, which are spaced apart horizontally, but whose end surfaces form the aforesaid curvature. Namely, if those end surfaces are interpolated to form a continuous line, the portion of that line which spans between the circumference of the protuberance to the apex thereof would be delimited between functions (1) and (2).

In another embodiment, at least one protuberance has an abrasion resistance of between 1 to 125 $mm^3$ (by DIN 53516). In another embodiment, at least one protuberance has an abrasion resistance of between 1 to 20 $mm^3$. In another embodiment, at least one protuberance has an abrasion resistance of between 1 to 60 $mm^3$. In another embodiment, at least one protuberance has an abrasion resistance of between 20 to 110 $mm^3$. In another embodiment, at least one protuberance has an abrasion resistance of between 40 to 80 $mm^3$. In another embodiment, at least one protuberance has an abrasion resistance of between 30 to 60 $mm^3$. In another embodiment, at least one protuberance has an abrasion resistance of between 50 to 120 $mm^3$.

In another embodiment, at least one protuberance has an abrasion resistance of less than 125 $mm^3$ (by DIN 53516). In another embodiment, at least one protuberance has an abrasion resistance of less than 100 $mm^3$. In another embodiment, at least one protuberance has an abrasion resistance of less than 80 $mm^3$.

In another embodiment, a protuberance comprises a rubber cup. In another embodiment, a protuberance comprises natural rubber compounds. In another embodiment, a protuberance comprises synthetic rubber compounds such as TPU or TPR. In another embodiment, a protuberance comprises silicone. In another embodiment, a protuberance a plastic material such as PA 6 (nylon), PA6/6 (nylon)+glass fiber, ABS, TPU, Glass fiber, Polypropylene, POM (Polyoxymethylene), or any combination thereof. In another embodiment, a protuberance comprises a metal such as aluminum, steel, stainless steel, brass, or metal alloys. In another embodiment, a protuberance comprises compound materials such as glass fibers, carbon fibers, kevlar, or any combination thereof. Each possibility represents a separate embodiment of the present invention.

In another embodiment, the basic requirement for continuous balancing a user with footwear of the invention is achieved when the device comprises two protuberances having a base surface as described, in a column-like order and in the offset arrangement. In another embodiment, the bulbous structure of the protuberance together with its shore hardness, limited deformation capacity, and its shock absorbing capacity are of great importance for continuous balancing a user. In another embodiment, the protuberance's hardness allows limited deformity/compressibility.

In another embodiment, limited deformity/compressibility results in less than 20% protuberance height loss upon maximal impact (the entire weight of the subject is exerted on the protuberance). In another embodiment, limited deformity/compressibility results in less than 15% protuberance height loss upon maximal impact. In another embodiment, limited deformity/compressibility results in less than 10% protuberance height loss upon maximal impact. In another embodiment, limited deformity/compressibility results in less than 20% protuberance diameter (any diameter along the protuberance) increase upon maximal impact. In another embodiment, limited deformity/compressibility results in less than 15% protuberance diameter increase upon maximal impact. In another embodiment, limited deformity/compressibility results in less than 12% protuberance diameter increase upon maximal impact.

In another embodiment, the basic requirement for continuous balancing a user with footwear of the invention is achieved when the device-footwear comprises two bulbous protuberances having a base surface as described, in a column-like order, in the offset arrangement, having a shore hardness as defined herein, having limited deformation capacity, and having shock (energy) absorbing capacity (as opposed to a spring). In another embodiment, offset arrangement refers to the peak of the protuberances as being offset). In another embodiment, does not include the base the protuberance's is not in an offset arrangement/position.

In another embodiment, the phrase "continuous balancing a user" includes constantly inducing a user to stabilize his posture and gait with minimal risk of falls and injuries. In another embodiment, the phrase "continuous balancing a user" includes developing proprioceptive and/or kinesthetic skills in a user. In another embodiment only the two bulbous protuberances can support the user's foot when the two spring elements are placed on a ground surface.

In another embodiment, a shoe of the footwear is in a balanced position, wherein the balanced position is a position whereby the device provides a reduced inversion or a reduced eversion to the subject's foot during the stance phases. In another embodiment, a balanced position is a position wherein at least one protuberance is offset with respect to the centerline. In another embodiment, a balanced position is a position wherein the forward protuberance, the rearward protuberance, or both are offset with respect to the centerline. In another embodiment, when both the forward protuberance and the rearward protuberance are offset with respect to the centerline, each protuberance is within or on a different side of the centerline (dividing the outer-sole/innersole to 2). In another embodiment, when both the forward protuberance and the rearward protuberance are offset with respect to the centerline, each protuberance peak is within or on a different side of the centerline.

In another embodiment, each position described hereinbelow is characterized by at least one protuberance being offset with respect to a centerline. In another embodiment, each calibration refers to the balanced position as the initial position. In another embodiment, after each calibration the forward protuberance, the rearward protuberance, or both are offset with respect to the centerline.

In another embodiment, an activity of a dorsi-flexor is increased by positioning the posterior protuberance to 2 mm-25 mm posteriorly from the balanced position. In another embodiment, an activity of a dorsi-flexor is increased by positioning the posterior protuberance to 5 mm-15 mm posteriorly from the balanced position. In another embodiment, an activity of a dorsi-flexor is increased by heightening the posterior protuberance. In another embodiment, an activity of a dorsi-flexor is increased by heightening the posterior protuberance by 0.5 mm-15 mm. In another embodiment, heightening the posterior protuberance results in a posterior protuberance which is 0.5 mm-15 mm higher than the anterior protuberance. In another embodiment, an activity of a plantar flexor is increased by positioning the posterior protuberance to 2 mm-25 mm anteriorly from the balanced position. In another embodiment, an activity of a plantar-flexor is increased by heightening (raising) the anterior protuberance. In another embodiment, an activity of an ankle evertor is increased by positioning the posterior protuberance to 0.5 mm-15 mm medially from the balanced position. In another embodiment, an activity of an ankle evertor is decreased by positioning the posterior protuberance to 0.5 mm-25 mm laterally from the balanced position. In another embodiment, an activity of an ankle dorsi-flexor is decreased by heightening (adding at least one spacer) the anterior protuberance from the neutral position which is the balanced position (the position wherein the device provides a reduced inversion or a reduced eversion to the subject's foot).

In another embodiment, an activity of the pes anserinus muscles (sartorius semitendinosus and gracilis) is decreased by positioning the posterior protuberance laterally from the neutral position which is the balanced position. In another embodiment, an activity of the quadriceps muscle is increased by positioning the posterior protuberance posteriorly from the neutral position which is the balanced position. In another embodiment, an activity of the hamstring muscle is increased by positioning the posterior protuberance anteriorly from the neutral position which is the balanced position. In another embodiment, an activity of the lateral knee muscles (vastus lateralis) is increased by positioning the posterior protuberance posteriorly and medially from the neutral position which is the balanced position. In another embodiment, an activity of the knee flexor muscles (gastrocnemius and hamstrings) is increased by heightening the anterior protuberance. In another embodiment, an activity of a hip external rotator muscle is increased by positioning the posterior protuberance to 2-20 mm medially from the balanced position. In another embodiment, an activity of a hip extensor muscle is increased by expanding the height of the anterior protuberance from the neutral position which is the balanced position In another embodiment, a balanced position is the position in which the footwear exerts the least valgus, varus, dorsal or plantar torque about the ankle in a subject. In another embodiment, a balanced position is the position in which the footwear provides the least or minimal lower limbs muscle activity. In another embodiment, a balanced position is the position in which the footwear provides balanced lower limbs muscle activity. In another embodiment, a balanced position is toning lower limb muscles. In another embodiment, a balanced position is toning the amount of tension or resistance to movement in a muscle involved in gait. In another embodiment, a balanced position is lower limb unloading that allows maximal ankle, knee, and hip joint mobility. In another embodiment, a balanced position is providing a reduction of muscle activity, larger passive ankle excursion, improved gait ability, or any combination thereof. In another embodiment, a balanced position is increasing step length, stance symmetry, or a combination thereof. In another embodiment, a balanced position is increasing the length of the force point of action in lower limb muscles such as but not limited to: soleus, tibialis posterior, and both gastrocnemius muscles.

In another embodiment, bi-lateral knee osteoarthritis is treated by using protuberances with soft hardness or resilience. In another embodiment, correction of early heel-rise in both right and left leg includes: (1) a 2 mm hard spacer is placed between the left posterior BP and the left shoe in order to bring the left foot to a slight plantar-flexion; and (2) a 2 mm hard spacer is placed between the right posterior BP and the right device in order to bring the right foot to a slight plantar-flexion.

In another embodiment, bi-lateral patello-femoral pain syndrome with a slight lateralization of the patellae in the left and right knees is treated by using protuberances having "hard" hardness or resilience, a 100 g spacer (disc shape) of 3 mm was introduced between the outsole and the posterior BP under the left leg and the right leg and (in order to maintain the anterior BPs at the same height and not create a plantar flexion) and a hard spacer and a soft spacer were introduced between the anterior BP and shoe both under the left leg and the right leg.

As seen in FIG. 2, the posterior protuberance is positioned generally underneath a calcaneus (heel, ankle) support portion 23 of support member 12. In some embodiments, the anterior protuberance may be positioned generally underneath a metatarsals support portion 25 and/or phalanges support portion 27 of support member 12.

Figure 12:
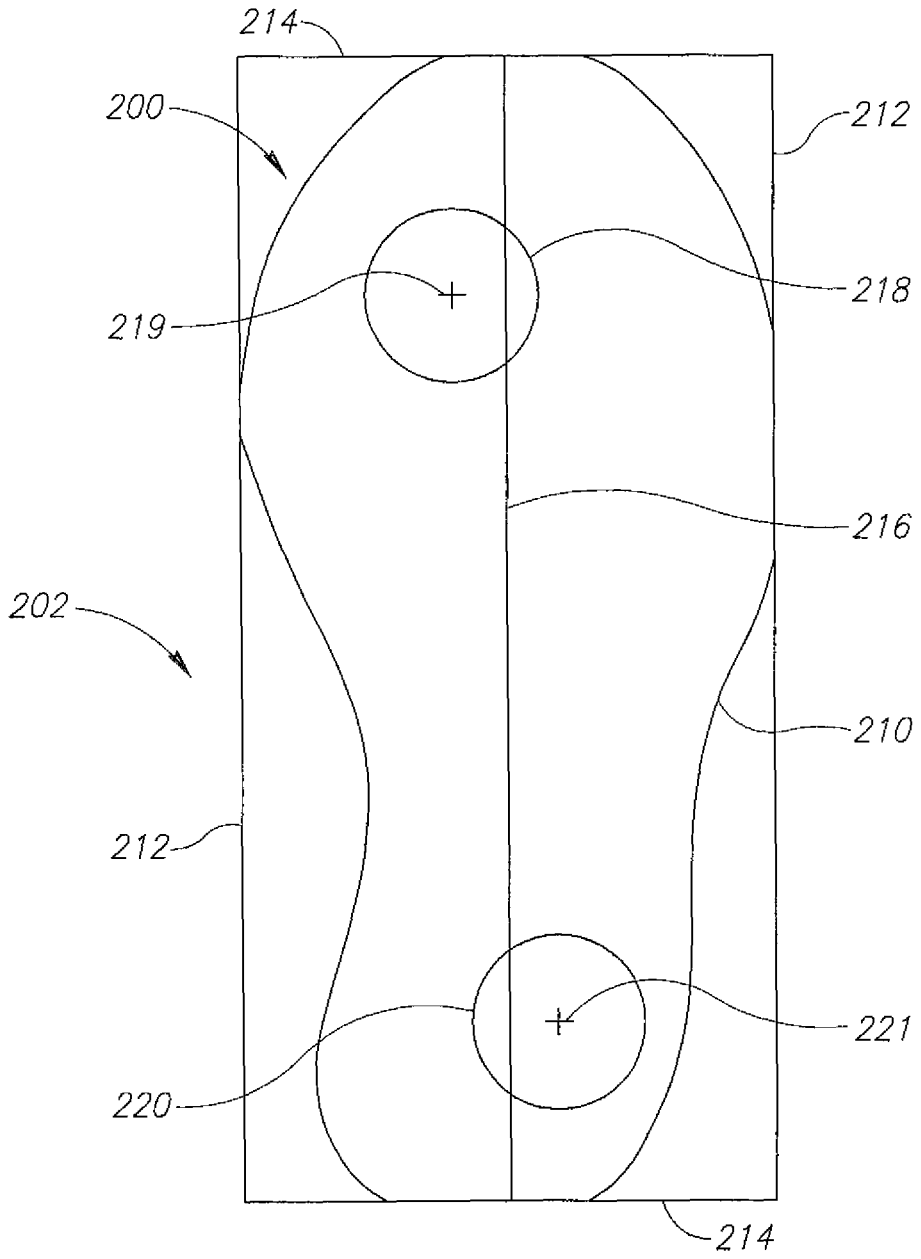
FIG. 12 is a simplified pictorial illustration of an alignment of the anterior (forward) and posterior (rearward) protuberances on a support member, according to embodiments of the present invention.

FIG. 12 is a simplified pictorial illustration of an alignment of the anterior (forward) and posterior (rearward) protuberances on a support member 200, according to embodiments of the present invention.

Centerline 216, in the embodiment shown in FIG. 12 is defined as a longitudinal straight line (median) that connects the middles of short sides 214 of a rectangle 212, the long sides 212 of which are parallel to centerline 216, and which delimits the contour 210 of the support member. In embodiments of the present invention contour 210 is the contour (254, see FIG. 14) of the foothold confined by the upper part (252, see FIG. 14) of the footwear (250, see FIG. 14), corresponding to the last which is used to form the footwear. In other embodiments of the present invention contour 210 is the outermost contour of the footwear. In other embodiments of the present invention contour 210 is the contour of the bottom surface of the sole of the footwear.

According to embodiments of the present invention, as shown in FIG. 12, forward protuberance 218 at the anterior (phalanges) portion of the support member (i.e. its front portion) is positioned medially offset to centerline 216. By "medially offset" is meant that a peak surface of protuberance 218 (marked by cross 219) is shifted from centerline 216 medially towards the inner side of support surface 200, facing the support member of the other foot (not shown in this figure). The peak surface is a surface on the protuberance which is furthest from the support surface with respect to other surfaces of the protuberance, and which comes in contact with the ground, when the user attaches the support member to the foot, and walks or stands on the ground.

According to embodiments of the present invention, as shown in FIG. 12, rearward protuberance 220 at the posterior (calcaneus) portion of the support member (i.e. its back portion) is positioned laterally offset to centerline 216. By "laterally offset" is meant that a peak surface of protuberance 220 (marked by cross 221) is shifted from centerline 216 laterally towards the outer side of support surface 200, away from the support member of the other foot (not shown in this figure).

In some embodiments of the present invention only forward protuberance 218 is offset 10 medially, while rearward protuberance 220 is substantially aligned with centerline 216. In some embodiments of the present invention only rearward protuberance 220 is offset medially, while forward protuberance 218 is substantially aligned with centerline 216.

The alignment of the protuberances shown in FIG. 12 is useful, for example, for exercising users with one or more of the following medical indications: medial compartment-knee 15 osteoarthritis (OA), medical meniscus tear or damage, genu varus, patello-femoral pain syd, patello-femoral problem (malalignment), lateral collateral ligamental damage or tear, bone bruise or avascular necrosis of the medial tibial plateau or the medial femoral condyle MTP/MFC (AVN), low back pain, hip OA, hip labrum damage (TCM), trochanteric bursitis, pes anseninus bursitis, ankle instability (supination and ext rut), achilles tendonitis and metatarsalgia.

Figure 13:
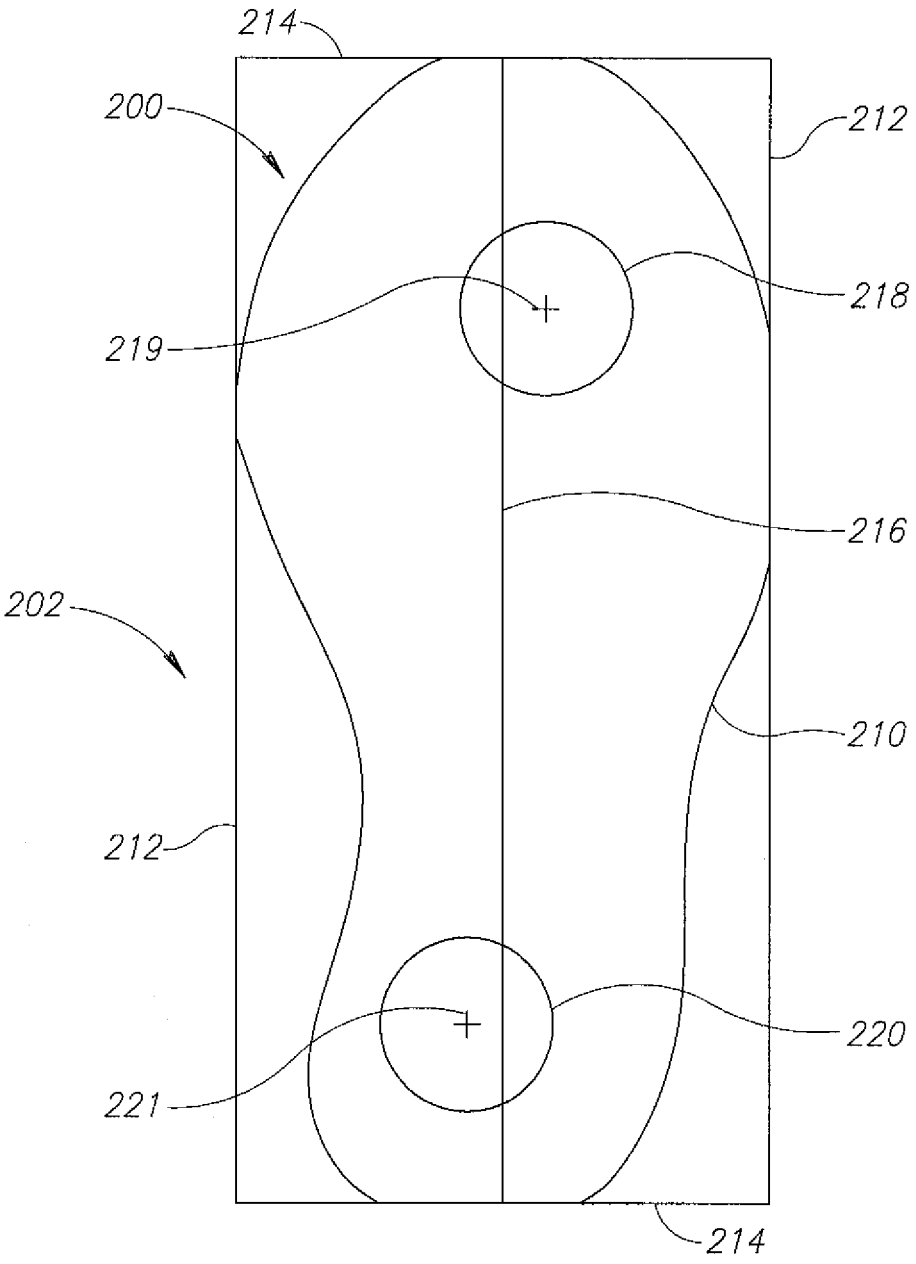
FIG. 13 is a simplified pictorial illustration of another alignment of the anterior and posterior protuberances on a support member, according to embodiments of the present invention.

FIG. 13 is a simplified pictorial illustration of another alignment of the anterior and posterior protuberances on a support member, according to embodiments of the present invention.

According to embodiments of the present invention, as shown in FIG. 13, forward protuberance 218 is laterally offset to centerline 216, whereas rearward protuberance 220 is medially offset to centerline 216.

In some embodiments of the present invention only forward protuberance 218 is offset laterally, while the rearward protuberance 220 is substantially aligned with centerline 216. In some embodiments of the present invention only rearward (posterior) protuberance 220 is offset laterally, while the forward (anterior) protuberance 216 is substantially aligned with centerline 216.

The alignment of the protuberances shown in FIG. 12 is useful, for example, for exercising users with one or more of the following medical indications: lateral meniscus tear or damage, lateral compartment knee osteoarthritis, valgus knee (genu valgus), patello-femoral pain syndrome, patello-femoral problem (malalignment), Medial collateral Ligament tear, bone bruise or avascular necrosis of the lateral tibial plateau or lateral femoral condyle hip labrum damage or tear, hip pain, ankle instability (pronoation), achilles tendonitis, tibilias insufficiency and metatarsalgia.

Figure 14:
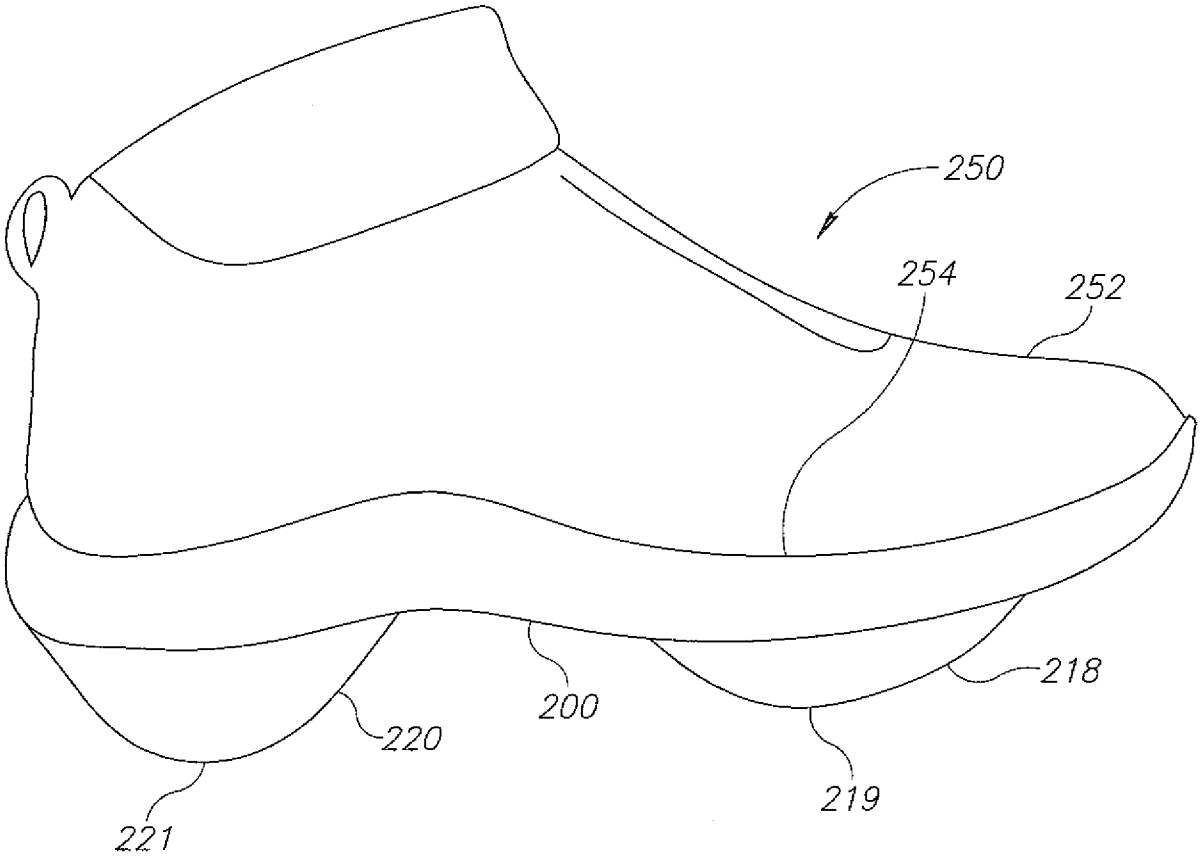
FIG. 14 is a simplified pictorial illustration of a sneaker constructed and operative in accordance with an embodiment of the present invention, whose rearward protuberance has a greater height than the height of the forward protuberance.

FIG. 14 is a simplified pictorial illustration of a sneaker 250 constructed and operative in accordance with an embodiment of the present invention, whose rearward protuberance 220 has a greater height than the height of the forward protuberance 218. It is noticeable that such arrangement facilitates initial contact between rearward protuberance 220 and the supporting ground (not shown in this figure) when a user wears the sneaker, before the forward protuberance is brought in contact with the ground. When both protuberances are placed in contact with the ground the foot of the user wearing sneaker 250 acquires a downward inclination with respect to direction of gait of the user.

Figure 15:
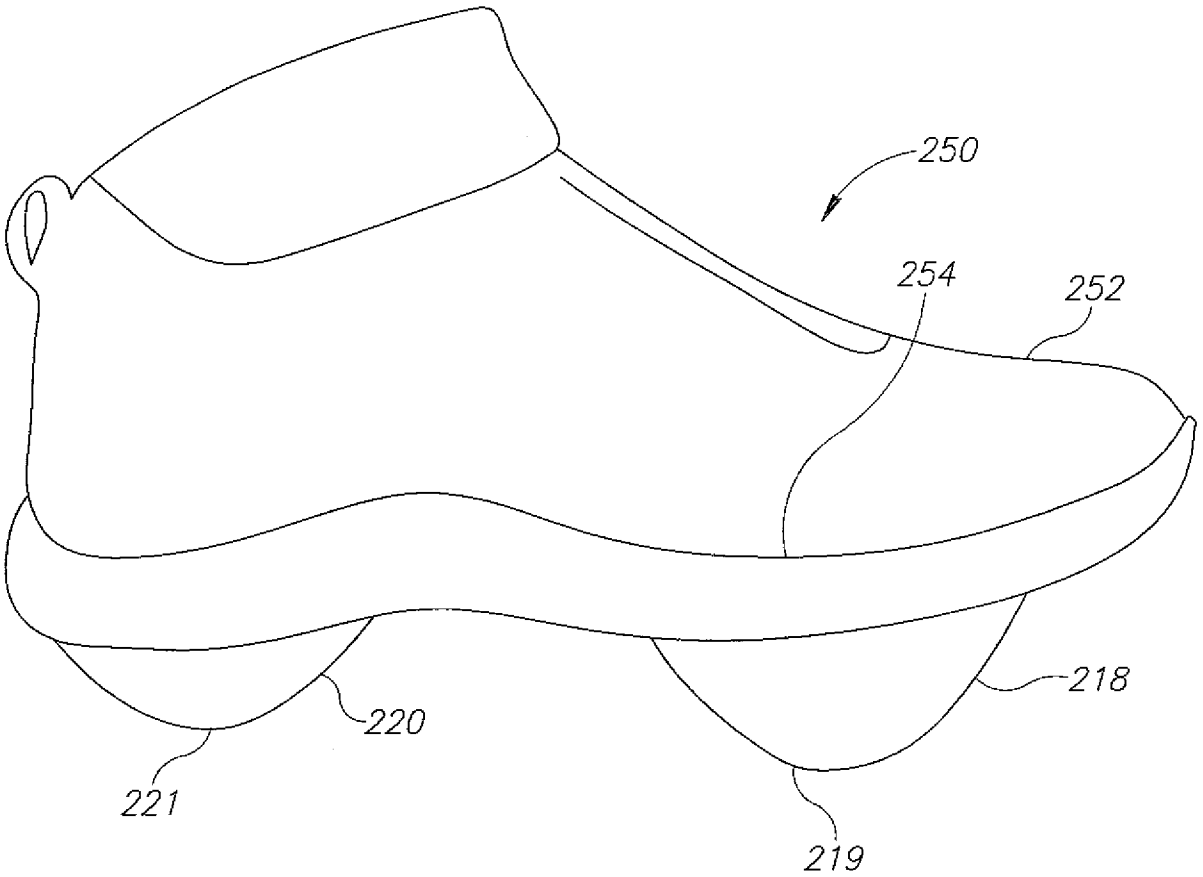
FIG. 15 is a simplified pictorial illustration of a sneaker constructed and operative in accordance with an embodiment of the present invention, whose forward protuberance has a greater height than the height of the rearward protuberance.

FIG. 15 is a simplified pictorial illustration of a sneaker 250 constructed and operative in accordance with an embodiment of the present invention, whose forward protuberance 218 has a greater height than the height of the rearward protuberance 220. In this embodiment when both protuberances are placed in contact with the ground the foot of the user wearing sneaker 250 acquires an upward inclination (with respect to the direction of gait of the user.

Figure 16:
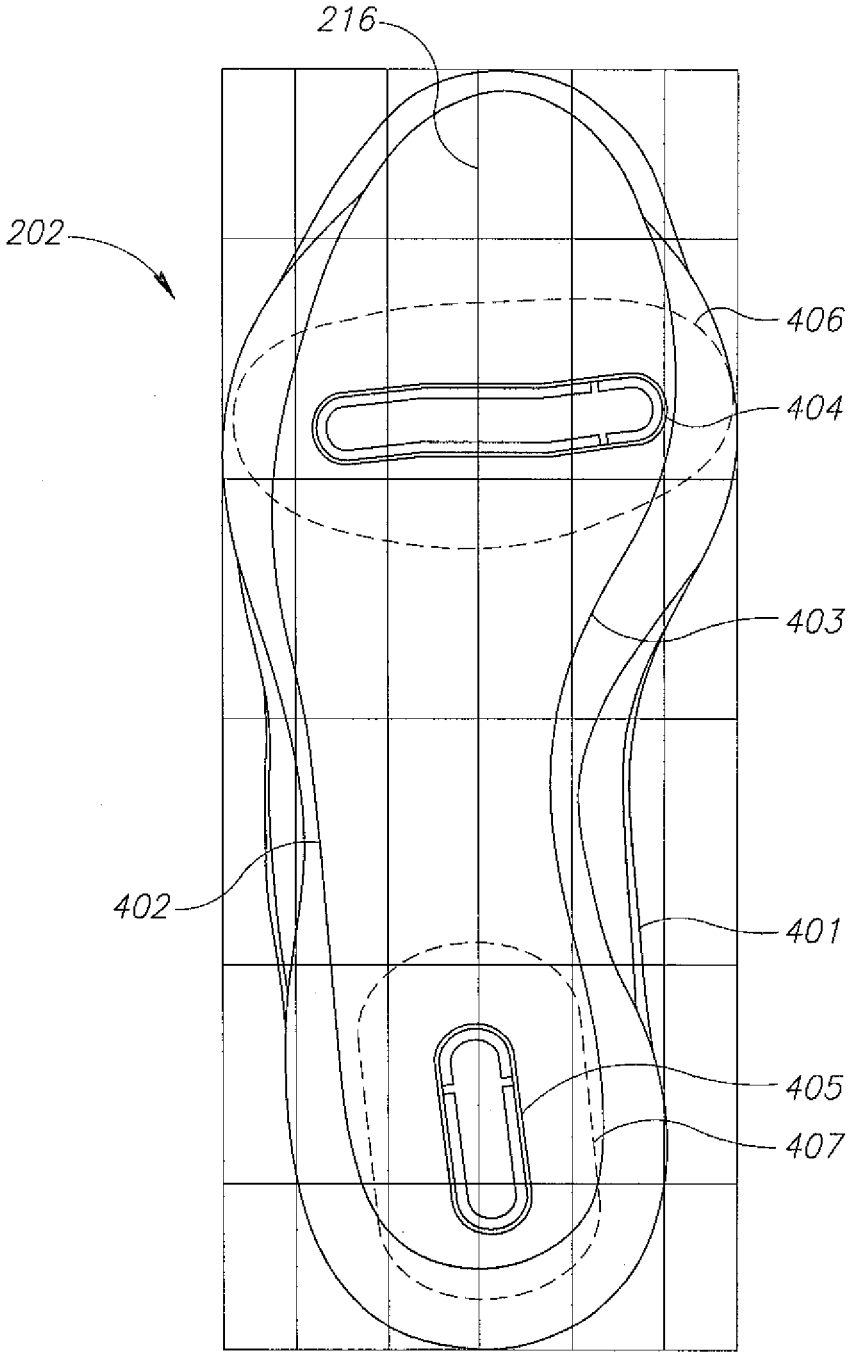
FIG. 16 illustrates maximal area boundaries of positioning of the anterior and posterior protuberances with respect to a support surface, according to embodiments of the present invention.

FIG. 16 illustrates maximal area boundaries of positioning of the anterior and posterior protuberances with respect to a support surface, according to embodiments of the present invention. Shown in this figure is a bottom view of a sneaker designed to be worn on a right foot of a user. The medial side is thus the right side of the drawing, facing the arc of greater curvature of the side arcs of the sneaker. The lateral side is opposite to the medial side that is the left side of the drawing, facing the arc of lesser curvature of the side arcs of the sneaker. A grid is provided, dividing rectangle 202 to 6*6 sub-rectangles (other divisions may apply too), to aid in the determining the position of the protuberances.

Indicated are the midsole 401 and contour 402 of the foothold which is determined by the last used in the making of the sneaker, 403 marking the medial curvature of contour 402. Front rail 404 and rear rail 405 are used for anchoring the protuberance. The area bordered by dotted line 406 marks the maximal area within which the peak surface of the anterior protuberance, i.e. the ground engaging surface of the anterior protuberance, may be located, according to some embodiments of the present invention. On the 6*6 grid, area 406 mainly stretches across the second row of sub-rectangles (counting from the front), and some of the third row of sub-rectangles. The area bordered by dotted line 407 marks the maximal area within which the peak surface of the posterior protuberance. On the 6*6 grid, area 407 mainly stretches across the third and forth sub-rectangles (adjacent centerline 216) of the fifth row (counting form the front) of the grid.

Figure 17:
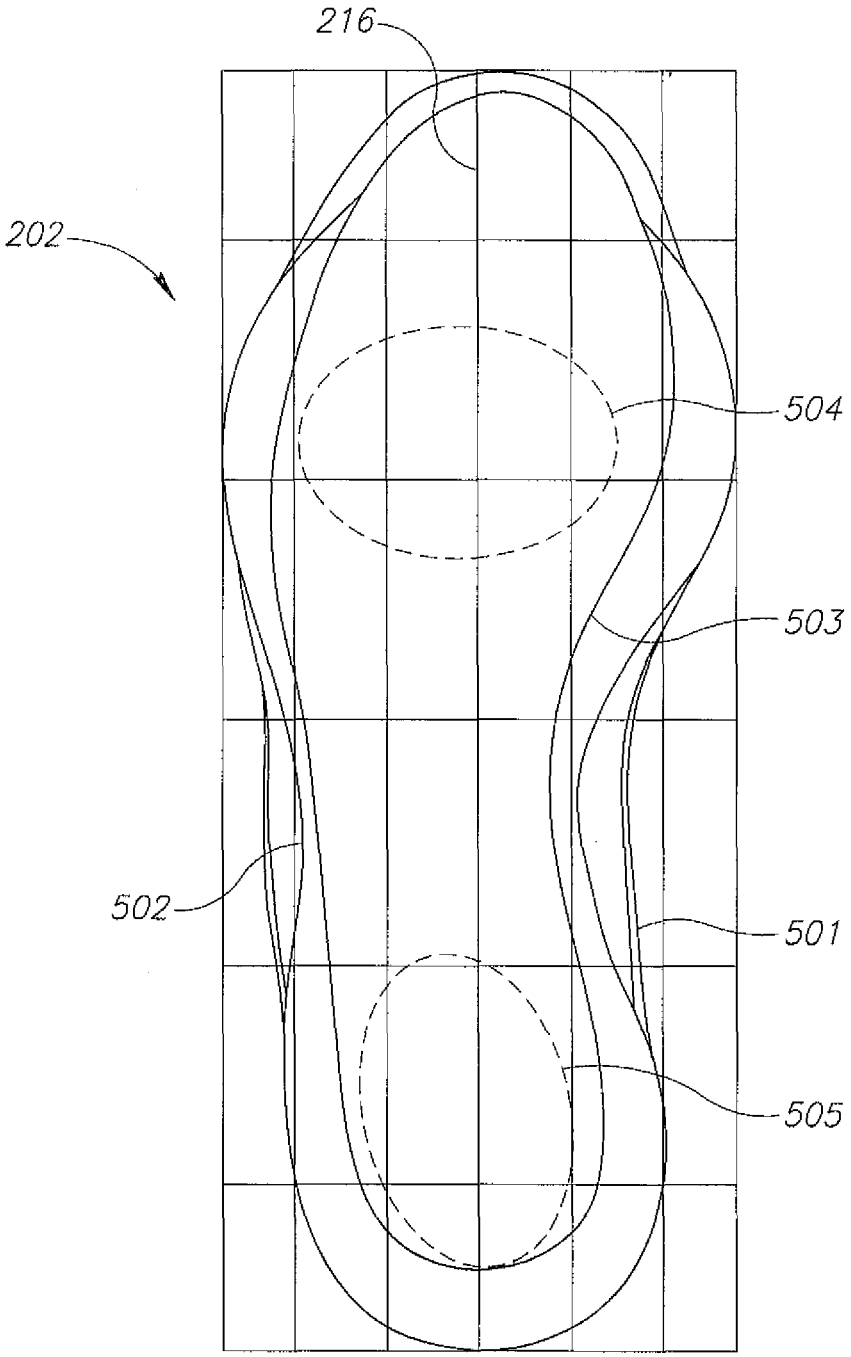
FIG. 17 illustrates effective area boundaries of positioning of the anterior and posterior protuberances with respect to a support surface, according to embodiments of the present invention.

FIG. 17 illustrates the effective area boundaries of positioning of the anterior and posterior protuberances with respect to a support surface, according to embodiments of the present invention. Indicated are the midsole 501 and outsole 502, contour 503 of the foothold which is determined by the last used in the making of the sneaker.

The area bordered by dotted line 504 marks the effective area within which the peak surface of the anterior protuberance, i.e. the ground engaging surface of the anterior protuberance, may be located, according to some embodiments of the present invention. On the 6*6 grid, area 504 mainly stretches across four sub-rectangles-two on either sides of centerline 216, of the second row of sub-rectangles (counting from the front), and some of the third row of sub-rectangles.

The area bordered by dotted line 505 marks the effective area within which the peak surface of the posterior protuberance. "Effective" refers to the effectiveness of use of the footwear according to embodiments of the present invention, which facilitates noticeable and useful proprioceptive/kinesthetic workout. On the 6*6 grid, area 505 mainly stretches across the third and forth sub-rectangles (adjacent centerline 216) of the fifth row (counting form the front) of the grid.

It is noted that the term "bulbous protuberance" is taken in the broadest sense to also include a cut bulbous protuberance, a truncated bulbous protuberance, a trimmed bulbous protuberance. If trimmed or cut, the trimmed or cut portion serves as the ground engaging of the protuberance, the base surface or both (e.g. both sides are cut or trimmed).

Figure 18A:
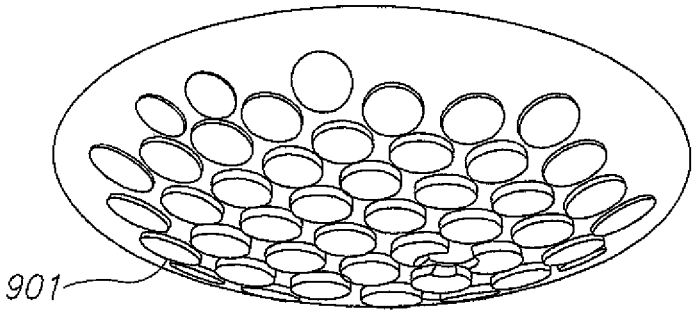
FIG. 18A is an isometric view of a protuberance suitable for use on a footwear, according to embodiments of the present invention.

FIG. 18A is an isometric view of a protuberance suitable for use on a footwear, according to embodiments of the present invention. Cleats 901 are provided on the surface of the protuberance for facilitating enhanced grip of the surface on which the user stands or walks. In some embodiments, spikes or grip means are constructed of any suitable material, such as but not limited to: elastomers such as rubbers or plastic materials. In some embodiments, spikes or grip means cover only a portion of a protuberance. In some embodiments, spikes or grip means cover at least a ground engaging surface of a protuberance (the surface in contact with the ground during stance). In some embodiments, a fixing means for securing a protuberance to the support portion is embedded within a spikes or a grip means. In some embodiments, a fixing means for securing a protuberance to the support portion is places in between spikes or a grip means. Each possibility represents a separate embodiment of the present invention.

Figure 18B:
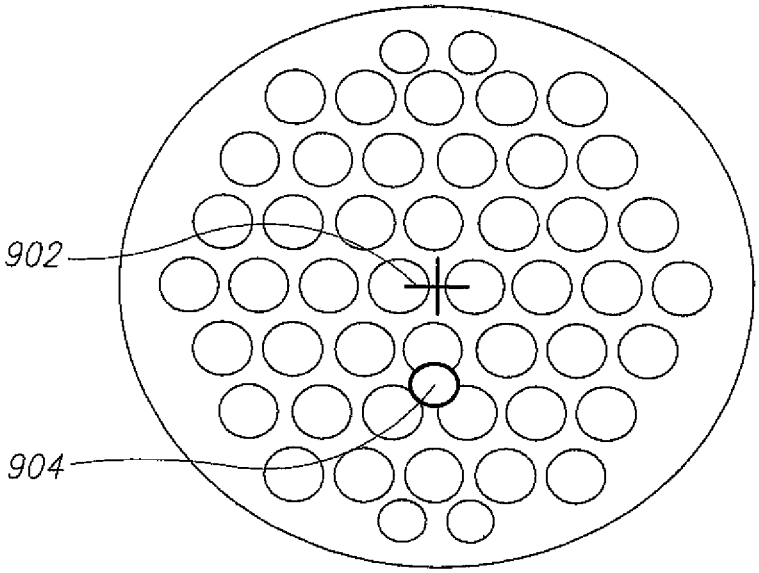
FIG. 18B is a frontal view of a protuberance suitable for use on a footwear, according to embodiments of the present invention.

FIG. 18B is a frontal view of a protuberance suitable for use on a footwear, according to embodiments of the present invention. The peak surface is marked by cross 902. Bore 904 is provided for a screw or other fastening arrangement to fix the protuberance in the desired position.

Figure 18C:
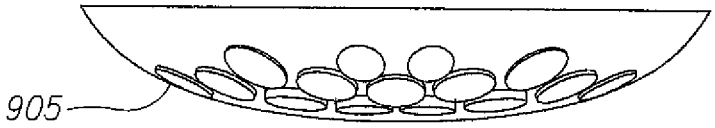
FIG. 18C is a side view of a protuberance suitable for use on a footwear, according to embodiments of the present invention.

FIG. 18C is a side view of a protuberance suitable for use on a footwear, according to embodiments of the present invention. Convexity 905 of the protuberance is clearly seen. Various convexities may be employed, all of which define a peak surface, typically (but not necessarily) at the center of the protuberance, which is the surface which comes in contact with the ground, when the user attaches the support member to the foot, and walks or stands on the ground.

It will be appreciated by persons skilled in the art that the present invention is not limited by what has been particularly shown and described hereinabove. Rather the scope of the present invention includes both combinations and sub combinations of the features described hereinabove as well as modifications and variations thereof which would occur to a person of skill in the art upon reading the foregoing description and which are not in the prior art.

EXAMPLES

Example 1

Treating a Bi-Lateral Knee Osteoarthritis (Medial Compartment, Genu Varus) with a Device of the Invention A 68 years old patient presented to the clinic with a major complaint of bi-lateral knee OA.

Anamnesis: Patient complained on bi-lateral knee pain, primarily in the left knee that lasted for 5 years prior to the visit. Patient experienced gradual pain increase and decrease in function (walking, ascending and descending stairs). Pain degree while walking was 6/10 (on a visual analogue scale of 10 cm, higher value means more severe). Patient suffered from moderate stiffness in the morning hours and a severe difficulties in getting out of cars.

Physical examination: Thigh muscles were atrophied. Knees were in varus alignment with limited knee extension on both sides (Lt.: −10°, Rt.: −5°). Palpation was characterized by tenderness on the medial joint line on the left and knee and in the pes anserinus region in the left knee. The right knee was also characterized by tenderness likewise the medial joint line and pes anserinus region were also characterized by tenderness. During walking patient experienced pain in the medial joint line in both knees in the heel-strike phase (VAS 5/10 in the left knee and 3/10 in the right knee). Patient also experienced pain in the pes anserinus region in the mid-stance to toe-off phase.

Imaging and lab: Knee X-ray in standing position: Antero-Posterior view reveals a joint space narrowing on the medial compartment and osteophytes, Kellgren & Lawrence classification 3 in both knees. Gait lab results (see table 1) showed velocity of 93 cm/sec, single limb support of 37.0% in the left leg and 38.1% in the right knee Step length: Left.: 61 cm Right 0.60 cm.

TABLE 1

Patient's gait parameters

| Visit | Velocity (cm/sec) | Left step length (cm) | Right Step length (cm) | Left Single Limb Support (in % of step cycle) | Right Single Limb Support (in % of step cycle) |
|---|---|---|---|---|---|
| $1^{st}$ (initial) | 93 | 61 | 60 | 37.0 | 38.1 |
| $2^{nd}$ (first follow-up) | 99 | 64 | 63.2 | 37.4 | 38.3 |
| $3^{rd}$ (second follow-up) | 106 | 65 | 64.2 | 37.7 | 38.5 |
| $4^{th}$ (third follow-up) | 110 | 65.5 | 65.0 | 38.0 | 38.6 |

Treatment

Bulbous protuberances (BPs with the lowest convexity (A) and soft hardness or resilience were placed under the hind foot and fore-foot.

Balancing: Patient was balanced by visually by reducing eversion and inversion through heel-strike, mid-stance and toe-off.

Pain: In order to reduce pain in the right medial knee joint line in heel-strike posterior right BP was shifted 1-2 mm laterally and fixed. Patient was then asked to walk 20 m with the device and reported reduction of pain from 5/10 to 3/10. Posterior right element was shifted 1-2 mm further laterally. Patient reported that pain disappeared in the right medial joint line while walking with the device.

In order to reduce the pain in the right pes anserinus, the anterior right BP was shifted 1-2 mm medially. At this point the patient reported he had no more pain in the right pes anserinus region while walking with the device.

In order to reduce pain in the left medial knee joint line in heel-strike the left posterior BP was shifted 1-2 mm laterally. Patient than reported a reduction of walking pain from 5/10 to 3/10 when wearing the device. After the left posterior BP was shifted 1-2 mm laterally the patient reported further reduction of pain to 2/10 in the left medial knee joint line while walking with the device. A further lateral shift of the left posterior BP increased the eversion in heel-strike in the left leg so patient was out of balance. Therefore, the left posterior BP was shifted back to the last position (where pain was 2/10 while walking).

In order to reduce the pain in the left pes anserinus, the anterior left BP was shifted 1-2 mm medially. At this point the patient reported a reduction of pain in the left pes anserinus region while walking with the device. After the left anterior BP was shifted additional 1-2 mm medially, pain disappeared in the left pest anserinus region upon walking with the device.

Heel-rise timing: Patient was asked to walk 20 m in order to confirm that he was still balanced and the heel-rise timing is proper. It was noted that the patient had early heel-rise in both right and left leg. At this phase a 2 mm hard spacer was placed between the left posterior BP and the left shoe in order to bring the left foot to a slight plantar-flexion. This time heel rise timing was proper in the left leg. At this phase a 2 mm hard spacer was placed between the right posterior BP and the right device in order to bring the right foot to a slight plantar-flexion. This time heel rise timing was proper in the right leg as well as in the left leg.

Prescription: On week 1 Patient was briefed with safety instructions and was asked to wear the device at home for 45 minutes daily (and walk in accumulative about 5 minutes a day as part of his daily activities at home). Patient was instructed to increase daily wearing time of the device by 5 minutes every week for the initial 6 weeks, reaching 75 minutes wearing time with the device every day (12-15 minutes of accumulative walking). Patient was monitored in the treatment center 6 weeks after his first visit, 3 months after his first visit, and 6 months after his first visit.

Treatment: Patient immediately reported reduction in pain while walking with the device; patient gradually reported a decrease in pain also when walking without the device. In the follow-up visits gait velocity was increased to 110 cm/sec an increase in step length of 65.5 cm in the left leg and 65.0 cm in the right leg, was observed. Single limb support bi-laterally was increased to 38.0% in the left leg and 38.6% in the right leg, patient had a lower difference between the single limb support of the right and the left leg (a more symmetric gait). After 10 weeks of treatment the patient reported that pain was substantially reduced during walking without the device and he found it much easier to stand for long periods. Patient gradually increased the daily use of the device, until reaching a daily usage of up to 3 hours a day. After 3 months patient was also allowed to walk outdoors with the device. After the initial 6 months patient continued follow-up visits twice-three times a year.

Example 2

Treating a Patello-Femoral Pain Syndrome (Hyper-Laxity and Genu Valgus) with a Device of the Invention A 30 years old female patient presented to the clinic with a diagnosis of patello-femoral pain syndrome.

Anamnesis: Patient complained of suffering from bi-lateral knee pain for the last 5 years. Left knee was more painful than the right knee. During the last 6 months there was an exacerbation in pain level to a level of approx. 5/10 on a visual analogue scale (exacerbation appeared following an intensive day of cleaning the house). She reported that she experiences anterior knee pain during sitting with flexed knees for over 20 minutes (moviegoers' knee). The patient who was an amateur dancer and ceased dancing since pain intensified. Patient reported of being extra flexible since childhood.

Physical examination: Patient had valgus alignment and recurvatum in both knees. On palpation tenderness was noted on the medial side of the patella. Patellar compression test was positive. When examining the patient's gait, patient reported pain is in the medial side of the patella while walking, pain appeared in heel-strike and is higher in the left knee compared to the right knee, 5/10 and 3/10, respectively.

Imaging/Gait: X-ray of the knees showed a slight lateralization of the patellae in the left and right knees. Gait lab results showed a velocity of 110 cm/sec, single limb support of 41.8% in the right leg and 42.4% in the left knee. Step length: Left: 57 cm Right 0.58 cm.

Treatment: identical BPs with B convexity and "hard" hardness or resilience were placed under the hind foot and fore-foot in the left and in the right leg. A 100 g spacer (disc shape) of 3 mm was introduced between the outsole and the posterior BP under the left leg and the right leg and (in order to maintain the anterior BPs at the same height and not create a plantar flexion) a hard spacer and a soft spacer were introduced between the anterior BP and shoe both under the left leg and the right leg.

Balancing: Patient was balanced by visually, reducing eversion and inversion through heel-strike, mid-stance and toe-off.

Pain: In order to reduce pain in the right patella in heel-strike posterior BP was shifted 3 mm anteriorly and 2 mm medially under the right leg. Patient then reported feeling no pain in the right knee while walking with the device. In order to reduce pain in the left patella in heel-strike posterior BP was shifted 3 mm anteriorly and 2 mm medially under the left leg. Patient then reported feeling a 70% decrease in pain at the medial side of the patella in the left knee while walking with the device. At this point posterior BP of the left foot was shifted further 1 mm anteriorly. Patient reported that walking with the current configuration of the device left her only with very mild pain (1-2/10) in the medial side of the left patella.

Heel-rise timing: Patient was asked to walk 20 m in order to confirm that she is still balanced and the heel-rise timing is proper. It was noted that the patient had delayed heel-rise in both right and left foot. At this phase a 2 mm hard spacer was placed between the left anterior BP and the left shoe in order to bring the left foot to a slight dorsi-flexion. Patient was observed walking with the device—heel rise timing was proper in the left foot. At this phase a 2 mm hard spacer was placed between the right anterior BP and the right shoe in order to bring the right foot to a slight dorsi-flexion. Patient was observed walking with the device—heel rise timing was now proper in the right leg.

Prescription: Patient was briefed with safety instructions and was asked on week 1 to wear the device at home for 45 minutes daily (and walk in accumulative about 5 minutes a day as part of his daily activities at home). Patient was instructed to increase daily walking time with the device by 5 minutes every week for the initial 4 weeks, reaching 60 minutes wearing time of the device every day (accumulatively walking or standing 7-10 minutes a day). Patient was monitored in the treatment center 4 weeks after her first visit, 10 weeks after her first visit, and 5 months after her first visit.

Treatment course: Patient immediately reported reduction in pain while walking with the device; patient gradually reported a decrease in pain also when walking without the device to a level of 2/10 after 3 months. She was now able to sit for long periods of time without pain and walked painlessly without the device. In the follow-up visits an increase in step length bi-laterally, a decrease in step length difference, a decrease in single limb support bi-laterally (towards 40%) and a decrease in single limb support difference (see table 2 for gait parameters) were observed. Patient gradually increased the daily use of the device, until reaching a daily usage of 2 hours after 5 months (accumulative walking of 20 minutes a day). After 5 months patient arrived to 2-3 follow-ups every year.

TABLE 2

Patient's gait parameters

| Visit | Velocity (cm/sec) | Left step length (cm) | Right Step length (cm) | Left Single Limb Support (in % of step cycle) | Right Single Limb Support (in % of step cycle) |
|---|---|---|---|---|---|
| 1st (initial) | 110 | 58 | 57 | 42.4 | 41.8 |
| 2nd (first follow-up) | 117 | 61 | 60.2 | 42.0 | 41.5 |
| 3rd (second follow-up) | 120 | 63 | 62.3 | 41.6 | 41.1 |
| 4th (third follow-up) | 125 | 64 | 63.5 | 41.1 | 40.7 |

Example 3

Treating a Degenerative Medial Meniscus Tear (Radial Tear in the Posterior Horn of the Medial Meniscus) with a Device of the Invention 57 years old patient presented to the clinic with a major complaint of left medial meniscus tear.

Anamnesis: Patient suffered from occasional knee pain for the last 6 years with symptoms alternating between left and right knees. 4 weeks prior to arrival to the clinic he had an event of acute pain in his left knee while having is evening walk. He ruled out any knee trauma.

Upon admission pain in the left knee is 6/10 (on a visual analogue scale of 10 cm) in the medial joint line. Patient reports that he suffered great pain upon walking and unable to fully extend his knee.

Physical examination: In inspection the knees are in varus alignment. The left knee is slightly flexed when standing and a mild atrophy of the VMO muscle is apparent. Patient had limited left knee extension of: 10°. In palpation there was tenderness on the medial joint line of the left knee and McMurray's Test for the left medial meniscus was positive. Patient did not extend his left leg fully when walking Patient reported of pain in the medial joint line in the left knee in the heel-strike phase.

Imaging and lab: Knee X-ray while standing: Antero-Posterior view showed mild changes in the medial compartment bi-laterally. In MRI a radial tear of the posterior horn of the left medial meniscus was observed. Gait lab results (see table 3) showed velocity of 85 cm/sec, single limb support of 35.6% in the left leg and 39.5% in the right leg Step length: Left.: 60 cm Right 0.58 cm.

TABLE 3

Patient's gait parameters

| Visit | Velocity (cm/sec) | Left step length (cm) | Right Step length (cm) | Left Single Limb Support (in % of step cycle) | Right Single Limb Support (in % of step cycle) |
|---|---|---|---|---|---|
| 1st (initial) | 85 | 60 | 58 | 35.6 | 39.5 |
| 2nd (first follow-up) | 95 | 63 | 61.3 | 36.9 | 39.3 |
| 3rd (second follow-up) | 107 | 66 | 64.5 | 37.5 | 39.3 |
| 4th (third follow-up) | 120 | 68 | 67 | 38.5 | 39.5 |

Therapy: identical BP's with the B convexity were fixed under the hind-foot and fore-foot of the patient's right foot. BPs had "soft" hardness. Under the left foot two BPs with C convexity (which is higher than B) were placed under the hind-foot and fore-foot. BP's under the left foot had higher convexity in order to introduce higher perturbation/instability under the left foot, thus, allegedly, promoting more coordinated recruitment of muscles and reducing the muscle guarding of the left knee. The higher convexity under the left foot also provided additional height compared to the right foot, thus promoting "off loading" (a shift of weight of the body from the affected, left leg to the right leg).

Balancing: Patient was balanced by visually reducing eversion and inversion through heel-strike, mid-stance and toe-off.

Pain: In order to reduce pain in the left medial knee joint line in heel-strike posterior left BP was shifted 1-2 mm laterally. Patient reported pain in the left medial joint line was reduced while walking with the device from 6/10 to 4/10. At this point left posterior BP was shifted 1-2 mm further laterally. Patient reported that the pain was further reduced to 2/10. Left posterior BP was shifted 1-2 mm further laterally. After the last lateral shift it was noted that upon heel strike the patient went into increased eversion and therefore, the left posterior BP was fixed back in the previous position (Where pain was 2/10).

Heel-rise timing: Patient was asked to walk 20 m in order to confirm that he is still balanced and the heel-rise timing is proper. An early heel-rise in the left leg was observed. A soft spacer of 2 mm was introduced between the posterior left BP and the device. Once the patient walked with the device, heel rise timing was corrected for the left leg. In this case, the spacer was a soft spacer in order to reduce the impact in heel strike.

Prescription: Patient was briefed with safety instructions and was asked to wear the device at home for 45 minutes a day on week 1 (and walk in accumulative about 5 minutes a day as part of his daily activities at home). Patient was instructed to increase daily wearing time of the device by 5 minutes every week for the initial 3 weeks, reaching 60 minutes wearing time with the device every day (8-10 minutes of accumulative walking or standing). Patient was monitored in the treatment center 3 weeks after his first visit, 6 weeks after his first visit, and 3 months after his first visit.

Treatment: Patient immediately reported reduction in pain while walking with the device; patient gradually reported a decrease in pain also when walking without the device. After 3 months of treatment pain in the left knee was decreased to 2/10. Gait (see table 3) velocity was increased, an increase in step length of the left and right leg was observed and single limb support was increased in the left leg and in the right leg. Patient had a lower difference between the single limb support of the right and the left leg (a more symmetric gait). The patient reported an increasing alleviation of pain whilst walking with street shoes or barefooted. Clinical visual gait assessment showed full extension of the left knee during the stance phase Once pain was reduced, full extension reached and the symmetry in single limb support improved the different calibrations on the right and left systems was evened out. The patient had "C" BP's under the hind-foot and the fore-foot of both legs. The additional soft spacer was removed from under the posterior left BP Patient gradually increased the daily use of the device, until reaching a daily usage of up to 2 hours a day. After 3 months patient was also allowed to walk outdoors with the device. After the first 6 months, patient arrived to the center 2-3 times a year for follow-up visits. The additional spacer that was introduced between the posterior left BP and the shoe was removed after the difference in single limb support was reduced below 2%.

Example 3

Left Anterior Cruciate Ligament Tear (No Pain) with a Device of the Invention A 27 years old patient presented to the clinic with a major complaint of left Anterior Cruciate Ligament (ACL) tear.

Anamnesis: 2 months prior coming to the clinic the patient twisted his left knee in a soccer game. Following this event the knee got swollen and painful. Patient was treated in a physiotherapy clinic since the injury and suffered no pain but had experienced, twice a week, events of "giving-way" in the left knee. He was also unable to enjoy in activities such as soccer, running or jumping.

Physical examination: On observation the knees were in a varus alignment. Anterior drawer test was positive in the left knee. McMurry and valgus stress tests were negative. Imaging and lab: MRI revealed that a left ACL tear is present. Gait lab results (see table 4) showed velocity of 110 cm/sec, single limb support of 38.2% in the left leg and 40.5% in the right leg Step length: Left.: 63 cm Right: 62 cm.

TABLE 4

| Patient's gait parameters | | | | | |
|---|---|---|---|---|---|
| Visit | Velocity (cm/sec) | Left step length (cm) | Right Step length (cm) | Left Single Limb Support (in % of step cycle) | Right Single Limb Support (in % of step cycle) |
| $1^{st}$ (initial) | 110 | 63 | 62 | 38.2 | 40.5 |
| $2^{nd}$ (first follow-up) | 123 | 66 | 65.2 | 39.0 | 40.3 |
| $3^{rd}$ (second follow-up) | 135 | 70 | 69.5 | 39.5 | 40.1 |
| $4^{th}$ (third follow-up) | 140 | 72 | 71.6 | 39.9 | 40 |

Therapy: identical BPs with B convexity and "hard" hardness were fixed under the hind-foot and fore-foot of the patient's right foot and the patient's left foot. A 100 g weighted spacer (disc) of 2 mm was introduced between the footwear and the posterior BP under the left foot and the right foot and (in order to maintain the anterior BPs at the same height and to avoid a plantar flexion) a hard and a soft spacers was introduced between the anterior BP and outsole both under the left foot and the right foot. The weighted spacer was introduced in order to induce increased activity in the muscles of the left leg and right leg. BPs convexity was planned to be increased as the treatment progressed.

Balancing: Patient was balanced by visually reducing eversion and inversion through heel-strike, mid-stance and toe-off.

Pain: Patient had no pain and was calibrated according to the balancing criteria.

Heel-rise timing: Patient was asked to walk 20 m in order to confirm that he is still balanced and the heel-rise timing is proper. Heel-rise was proper.

Prescription: Patient was now briefed with safety instructions and was asked on week 1 to wear the device at home for 1 hour a day (and walk in accumulative about 10-15 minutes a day as part of his daily activities at home). Patient was instructed to increase daily wearing time of the device by 10-15 minutes every week for the initial 3 weeks, reaching 90 minutes wearing time with the device every day (about minutes of accumulative walking a day). Patient was monitored in the treatment center 3 weeks after his first visit, 6 weeks after his first visit, and 3 months after his first visit.

Treatment course: Patient reported a significant reduction in "giving-ways" already after 3 weeks of treatment, in gait lab velocity was higher; step length and single limb support were increased in the left and in the right knee. In the first follow-up meeting the BPs convexity was increased to "C" under the hind-foot and the fore-foot both in the left and in the right leg. After 6 weeks of treatment, the patient was also given designated exercise to incorporate with the device. After 3 months of treatment, patient returned to play soccer as an amateur. The convexity of all 4 BPs was gradually increased. The daily usage of the device was increased until reaching up to 3 hours daily wearing time both indoors and outdoors.

Example 4

Hip Osteoarthritis

A 72 years old female patient presented to the clinic with pain, difficulty in walking, difficulty ascending stairs and difficulty in prolonged standing.

The patient reported having pain in the area of the right greater trochanter and the inguinal area. The pain was felt during walking, getting up from a seated position and while ascending stairs. The patient had the pain for the past year and reported it was gradually worsening. She also described stiffness around the right hip area after getting up in the morning lasting for 15 minutes.

Physical Examination: On observation the patients' knees are in a mild valgus alignment and she stands with an anterior pelvic tilt (flexion deformity of the right hip). Internal rotation of the right hip in neutral position was full but painful at the end of range. Right hip internal rotation in 90 degrees of flexion was 15 degrees and painful (30 degrees in the left hip). FADIR test was positive on the right and negative on the left. Right hip extension showed limited range of motion in comparison to the left (10 degrees and 25 degrees respectively). Clinical gait assessment revealed increased pelvic posterior rotation on the right during late stance. The patient reported she feels the inguinal pain during both heel strike and late stance. She rated the pain as 4/10 on VAS.

Imaging and Gait lab: X-rays in the supine position revealed right hip joint space narrowing with subchondral bone sclerosis and subchondral bone cysts. The left hip showed joint space narrowing to a lesser degree. Gait lab data provided: gait velocity of 91 cm/sec, right step length: 55 cm., left step length 52.3 cm., right single limb support 37.3% and left single limb support 39.1%. In/out toeing angle of the foot was −3.1 degrees on the right (indicating 3.1 degrees of in-toeing) and +5 degrees on the left (indicating 5 degrees of out-toeing) (see table 5 for gait lab data).

was reduced to a 2/10 (from a level of 4/10). To reduce the pain further the posterior right BP was calibrated and fixed in a new position (1 mm posteriorly and 1 mm medially). The patient reported that pain during heel strike was reduced to a mild discomfort. However, the foot seemed to be inverting during heel strike phase so the posterior Rt. BP was calibrated and fixed 1 mm lateral to its previous position. As a result the pain was decreased to a level of 1/10 while walking with the system. The left system was balanced and further calibrated to minimize eversion and inversion through all phases of the stance.

Heel-Rise Timing: The patient was asked to walk 20 meters in order to see if the heel-rise was timed in the gait cycle. It was noted that the patient had a late heel-rise in both the right and the left leg. In order to correct this, another 2 mm hard spacer was fixed between the right anterior BP and the right boot, thus bringing the right ankle into a more plantar flexed position. The patients gait was reassessed and the heel rise observed on the right was normalized. The patient reported at this point that she felt a significant decrease in the pain during late stance (0.5 on VAS). This is allegedly because the dorsiflexion created reduced the need for hip extension at this phase of gait. Thus, the patient was better supported by the footwear. In order to correct the timing of the left heel-rise another 2 mm hard spacer was fixed between the left anterior BP and the left boot, thus bringing the left ankle into a more plantar flexed position. The patient's gait was reassessed: left heel rise was normalized.

TABLE NO. 5

Patient Gait Parameters

| Visit | Velocity (cm/sec) | Left step length (cm) | Right Step length (cm) | Left Single Limb Support (in % of step cycle) | Right Single Limb Support (in % of step cycle) | Left In/Out Toeing (+out −in) | Left In/Out Toeing (+out −in) |
|---|---|---|---|---|---|---|---|
| 1st (initial) | 91.0 | 55.0 | 52.3 | 39.1 | 37.1 | −3.1 | +5 |
| 2nd (first follow-up) | 95 | 56.1 | 54.5 | 39.0 | 38.0 | −2.7 | +6.1 |
| 3rd (second follow-up) | 100 | 56.5 | 54.9 | 39.3 | 38.5 | −1.3 | +6.5 |
| 4th (third follow-up) | 108 | 56.4 | 55.3 | 39.4 | 38.6 | −1.2 | +6.4 |

Treatment course: BP's with B (medium) convexity and "soft" resilience/hardness were connected and fixed under the hind-foot and fore-foot of the left and right footwear. A 100 g spacer (disc shaped) of 3 mm height was attached and fixed between the outsole and the posterior protuberance under both legs. In order to maintain the anterior protuberance at the same height so as not to create a plantar flexed position a hard spacer and a soft spacer were introduced and fixed between the anterior protuberance and footwear both under legs.

Balancing: The patient's device was calibrated and fine tuned during repeated clinical gait assessments with the device (footwear). During this process care is taken to reduce the eversion and inversion during heel strike, loading response, mid-stance and toe-off.

Pain: In order to reduce the pain in the right inguinal area during heel strike the posterior Rt. BP was calibrated 3 mm posterior and 2 mm medially. The patient reported that pain Treatment Plan: The patient was briefed about the safety instructions of the device and instructed to start the treatment with a total wearing time of 30 minutes a day for the first week of the treatment (accumulative weight bearing time was defined as 15% of total wearing time, i.e. 5 minutes). She was asked to increase the total wearing time of the device by 10 minutes a week for the first 6 weeks of the treatment, maintaining the relative 10% of accumulative weight bearing time. The patient was seen for follow up consultations 6 weeks after the initial consultation, 3 months after the initial consultation and 5 months after the initial consultation.

Treatment Progression: As described above during the initial consultation, the patient had an immediate reduction in pain while walking with the calibrated device. On the first follow up consultation the patient reported that she found house work much easier than previously and less painful. Follow up Gait lab results indicated an increase in velocity, step length and single support in both legs as well as an improvement in the symmetry of gait. The patient was asked to continue to add to the total wearing time at a rate of 15 minutes per week while increasing the accumulative weight bearing time to 15% of the total wearing time.

On the second follow up the patient reported that morning stiffness was substantially reduced and she found that walking outside without the device is easier. She reported she currently feels the pain around the greater trochanter when she walks for over 45 minutes (VAS 1-2/10). The pain in the inguinal area was very infrequent. By then, the patient was wearing the device for 4 hours a day and functioning indoors freely (Gait lab data provided in table no. 5). The posterior BP's on both devices were changed to C convexity (more convex) in order to provide a greater challenge for her neuromuscular system. Since C convexity protuberances are higher than the B convexity protuberances (which remained unchanged in the anterior protuberance on both the device on the left foot and the device on the right foot) a hard spacer was introduced between the outsole and the base of the anterior protuberance on both the right and the left boots. This was done without changing the location of the anterior protuberances. Following this calibration, the patient's gait was reassessed including balanced calibration (as explained above). The patient reported she had no pain or discomfort with the new calibration. She was instructed to maintain the overall treatment time.

After the initial 5 months the patient was seen twice a year for follow up consultations and monitoring. Her walking abilities and pain improved dramatically.

Example 5

Left Total Knee Replacement and Right Knee OA

A 71 years old male presented to the treatment center 3 months after undergoing a left total knee replacement.

Case History: The patient suffered from OA of the left knee for 5 years prior to undergoing an elective TKR. He suffered right knee medial and anterior pain for the last 2 years. The patient reported that he had physiotherapy for 3 months post surgery but he feels weak in the injured leg. He also reported of an increase in medial pain in the right knee since the surgery which he rated as 6/10 at its worst.

Physical Examination: On observation the patient bears more weight on the right leg, quadriceps and triceps surae on the left are atrophied compared to the right. Assessment of range of motion in the supine position revealed full extension of the right and left knees. Flexion on the right was 110 degrees and 120 on the left with left medial knee pain produced at the end of range. Palpation did not produce any pain in the left knee and produced medial joint line tenderness on the right knee. During clinical gait assessment the left knee was observed to have inadequate flexion during swing phase which resulted in circumduction of the hip as compensation. During stance phase the left knee did not fully extend and was kept at about 10 degrees flexion. The patient reported medial knee pain in the left knee was felt mainly during heel strike and loading phases. He rated that pain as 4/10 on VAS.

Imaging and Gait lab: X-rays in the supine position (regrettably X-rays in standing were unavailable at the initial consultation) showed the TKR prosthesis was well positioned and did not show any signs of infection or loosening. The left knee X-rays revealed mild-moderate medial joint space narrowing. Kellgern-Lawrence rating was impossible since X-rays were in supine. Gait lab data revealed: a gait velocity of 68 cm/sec., left single limb support: 32.3%, right single limb support 37.2%, left step length 51.1 cm. and right step length was 46.5 cm. (see table 6 for detailed gait lab data).

TABLE 6

| Patient Gait Parameters | | | | | |
|---|---|---|---|---|---|
| Visit | Velocity (cm/sec) | Left step length (cm) | Right Step length (cm) | Left Single Limb Support (in % of step cycle) | Right Single Limb Support (in % of step cycle) |
| 1st (initial) | 68.0 | 51.1 | 46.5 | 32.3 | 37.2 |
| 1st (initial) With the Device | 80.0 | 55.2 | 49.5 | 35.1 | 36.2 |
| 1st (initial) Barefoot retest | 74.2 | 55.0 | 48.1 | 33.8 | 36.9 |
| 2nd (first follow-up) | 79.3 | 58.1 | 56.3 | 35.8 | 37.9 |
| 2nd (first follow-up) With the Device | 88.6 | 59.4 | 58.1 | 36.7 | 38.3 |
| 2nd (first follow-up) Barefoot retest | 85.6 | 58.8 | 58.0 | 36.4 | 37.9 |
| 3rd (second follow-up) | 103.2 | 60.9 | 59.2 | 38.7 | 38.0 |
| 3rd (second follow-up) With the Device | 115.3 | 62.3 | 60.9 | 38.9 | 38.3 |
| 3rd (second follow-up) Barefoot retest | 110.4 | 61.7 | 60.7 | 38.1 | 38.9 |
| 4th (third follow-up) | 115.9 | 62.5 | 61.9 | 38.2 | 38.1 |
| 4th (third follow-up) With the Device | 117.2 | 63.0 | 62.4 | 37.9 | 38.0 |

Therapy: BP's with B convexity and "soft" resilience were attached and fixed under the hind-foot and the fore-foot of the left device. BP's with C convexity and "soft" resilience were attached and fixed under the hind-foot and the fore-foot of the right foot. Since C convexity BP's are higher than B convexity Protuberances, and since gait lab data showed the patient has reduced single limb support on the left leg, 3 hard spacers were inserted and fixed under the anterior and posterior BP's of the left foot. This calibration, called "off-loading", induces easier swing of the contra-lateral leg by increasing the height of the BP's in the affected leg. In this case the left leg is 3 mm. higher than the right leg.

In order to increase proprioceptive input, a 100 g disc was inserted between the shoe and the posterior B.P. of the left and right systems. This brought both ankles to a slightly plantar flexed position. This was not corrected since the left knee failed to reach full extension during stance the plantar flexion is supports it.

Balancing: The patients system was calibrated and fine tuned during repeated clinical gait assessments with the device. During this process care is taken to reduce the eversion and inversion during heel strike, loading response, mid-stance and toe-off.

Pain: In order to reduce the pain in the right medial knee the posterior BP of the right system was calibrated 2 mm. laterally and fixed in the new position. The patient then reported that his pain has reduced to 3/10 while walking with the device. The posterior protuberance of the right system was therefore calibrated another 2 mm. laterally and fixed in the new position. When the patient walked with the device again the pain was reduced to 1/10. The posterior protuberance of the right device was calibrated and fixed a further 1 mm. laterally but clinical gait assessment showed that the right foot was now excessively pronated and the patient did not report any further decrease in pain. The posterior BP of the right system was therefore recalibrated to its previous position and fixed there. Clinical gait assessment showed that the eversion of the right foot was now at an acceptable amount and the patient rated the medial knee pain as 1/10.

In order to improve the extension of the left knee during stance the posterior BP of the left footwear was calibrated and fixed 5 mm. anterior to its neutral position. The knee seemed to be more extended during stance phase and the gait velocity was increased. The patient reported that walking with the footwear is much more comfortable than walking with regular sneakers.

Heel-Rise Timing: The patient was asked to walk 20 m in order to confirm that he was still balanced and the heel-rise is well timed in the gait cycle. The clinical gait assessment showed an early heel rise on the left leg. In order to correct this, a hard spacer was introduced and fixed under the posterior BP in the left footwear. Repeated gait assessment showed that the left heel-rise had been normalized.

Gait lab Retest: Once the balancing process was completed the patient performed another gait lab test with the device. The results of this test were significantly better than the baseline results. Gait velocity increased to 80 cm/sec., left single limb support: 35.1%, right single limb support 36.2%, left step length 55.2 cm. and right step length was 49.5 cm. (see table 6 for detailed gaitlab data). The data from this test showed gait velocity was 74.2 cm/sec., left single limb support: 33.8%, right single limb support 36.9%, left step length 55.0 cm. and right step length was 48.1 cm. (see table 6 for detailed gaitlab data). These results show that the patients gait is much improved with the device and that some of the improved motor control (for example the improved left knee extension during stance) is retained for at least a short period of time.

Treatment Plan: The patient was briefed with safety instructions and instructed to start the treatment by wearing the device for an hour and a half daily on the first week of the treatment. Accumulated weight bearing time was set at 10% of the total time of wearing the footwear. Thus out of the hour and a half he was supposed to be in weight bearing for an accumulative period of 9-10 minutes. The patient was asked to increase the total wearing time of the footwear by 15 minutes on the second week, maintaining the relative 10% of accumulated weight bearing time. The patient was seen for follow up consultations 2 weeks after the initial consultation, 6 weeks after the initial consultation, 3 months and again 6 months after the initial consultation.

Treatment Progression: As mentioned above the patient felt an immediate pain relief in the right knee and had better knee extension on the left when walking with the footwear during the initial consultation. During the second follow up consultation the patient reported that he enjoyed walking with the footwear and found it easier and less painful to walk and function with it. The pain in the right knee was not constant now though its peak level did not decrease (VAS 6/10). Gait lab test revealed an increase in left single limb support (from 32.3% to 33.9%) and an increase in right step length (from 46.5 cm. to 47.3 cm., for gait lab details see table no. 6). Due to the improvement and due to the fact that differences between right and left single limb support and step length were still significant the calibration of the right and the left boots was left unchanged. The patient was asked to increase the total wearing of the footwear by 15 minutes per week. In addition he was instructed to walk continuously with the device indoors, starting from 2 minutes of continuous walking and increasing by 2 minutes every week.

On the second follow up the patient reported that he reached 2.5 hours of total wear time, out of which he had an accumulative weight bearing time of 15-20 minutes. In addition, he reported that he had much less pain in the right knee while performing daily activities without the footwear (VAS 3/10). Gait lab data revealed further increases in gait velocity (79.3 cm/sec.), left single limb support (35.8%) and right and left step length (56.3 cm. and 58.1 cm. respectively). These results represent a marked improvement in gait symmetry and mirror the patients' report of improvement in pain level and functional level. The calibration was therefore changed to C convexity on the anterior and posterior BP's of the left device. The hard spacer on the posterior protuberance of the left device was removed since the knee extension on barefoot gait was now full. The calibration in the right device remained unchanged. The patients gait was reassessed with the device and there were no gait deviations observed. The patient reported he felt comfortable walking with the new calibration and did not experience any symptoms. A gait lab test with the footwear was performed and showed encouraging results, as did a barefoot gait lab retest (see detailed results in table 6). The patient was asked not to increase wearing time as to allow for a customization process to take place. He was told to gradually increase total wearing time to 4 hours and increase accumulative weight bearing time to 15% of the total wearing time. In addition he was instructed to increase his indoor walking gradually to 15 minutes.

The patient continued his gait improvement and pain relief. On the third follow up consultation he was allowed to perform outdoor walking with the Device. Gait lab results are shown in table 6. The patient was seen again for a follow up consultation 6 months after the initial consultations in which he reported he had no pain or weakness in the left leg and had only mild (1-2/10) occasional pain in the medial aspect of the right knee. After this the patient was asked to come in for follow up consultations twice a year.

Example 6

Post Left Total Hip Replacement

A 75 years old male is presented to the treatment center 3 weeks following an elective right total hip replacement.

Case History: The patient had left hip pain for four years prior to surgery, with a significant increase in pain and functional limitations during the year prior to surgery. During the surgery a cemented total hip prosthesis was inserted. He was told to bear full weight on the operated leg but was unable to do so due to pain and fear that it will not support him. At the time he was first seen he is ambulating with a walker and confined to indoor walking only. Pain was felt around the surgical wound and deep in the groin area (VAS 5/10).

Physical Examination: On observation in standing the patient bears significantly more weight on the right leg and stands in forward flexion of the trunk. Ranges of motion measured in supine were: hip flexion-left: 80 degrees, right: 105 degrees. Internal rotation in neutral position-left: 15 degrees, right: 25 degrees. During clinical gait assessment the patient had great difficulty walking without the walker so the assessment was very minimal. The patient rated the pain as 5/10 on VAS and described the left leg as being very weak Imaging and Gait lab: X-rays showed the prosthesis was in good position without any signs of loosening or infection. The right hip showed mild joint space narrowing. Gait lab results showed gait velocity was 37 cm/sec., left step length—21 cm., right step length—25 cm., left single limb support—19.0%, right single limb support—42.1%.

Therapy: BP's with A level of convexity (low level) were attached and fixed under the hind-foot and fore-foot of the left device. BP's with C level (high level) of convexity were attached and fixed under the hind-foot and fore-foot of the right device. A 100 g spacer (disc) was inserted and fixed between the outsole and the posterior BP's of the left and the right footwear in order to increase the proprioceptive input during swing and improve pelvic muscular control during stance. In order to support the patient in the forward flexed position (and correct the plantar flexed position created by the insertion of the disc in the posterior BP's) 2 hard spacers and a soft spacer were inserted and fixed between the shoe and the anterior BP's on the left and the right devices. Since C convexity provides elevated height than convexity A, balancing was required. Because of the vast difference in single limb support between the left and right legs there was a need to "off-load" the left leg (for details about the rationale of off-loading see previous examples). For that purpose 2 hard spacers were inserted between the outsole and the anterior protuberance of the left boot. 2 additional hard spacers were inserted between the outsole and the base of the anterior BP of the left device.

Balancing: The patient's footwear was calibrated and fine tuned during repeated clinical gait assessments with the device. During this process care is taken to reduce the eversion and inversion during heel strike, loading response, mid-stance and toe-off.

Pain: In order to decrease the pain in the left hip during weight bearing, the posterior protuberance of the left footwear was calibrated and fixed 6 mm posteriorly and 4 mm medially to its previous position. The patient reported that pain decreased to a level of 4/10 on VAS and he found that bearing weight on the leg is now, easier. The posterior left BP was calibrated and fixed a further 2 mm posteriorly and 2 mm medially and the patient reported another decrease in pain level (3/10) and comfort in weight bearing. During clinical gait assessment it was clear that the gait velocity has increased and weight bearing on the left leg was performed with more movement into hip extension. This process continued until the posterior left BP was fixed 15 mm posteriorly and 8 mm medially to its original position. The patient had a marked improvement in pain (VAS 2/10) and symmetry of gait. The same process was repeated with the right device (i.e. the position of the posterior device was recalibrated and fixed to a more posterior and medial position and the patients' gait was reassessed). At the end of the calibration of the right boot, the posterior device was 9 mm posteriorly and 6 mm medially to its original position.

Heel-Rise Timing: The patient was asked to walk 20 m in order to confirm heel-rise is well timed in the gait cycle. An early heel-rise in the right foot was evident. In order to correct this, the soft spacer was removed from between the anterior BP and the shoe of the right footwear. A clinical gait assessment was performed and it was noted that the heel-rise in the right leg had been normalized.

Gait lab Retest: Once the balancing process was completed the patient performed another gait lab test with the device. The results of this test were significantly better than the baseline results. Gait velocity increased to 55.0 cm/sec., left single limb support: 27.3%, right single limb support 39.1%, left step length 37.2 cm. and right step length was 39.3 cm. (see table 7 for detailed gait lab data). The data from this test showed gait velocity was 49.1 cm/sec., left single limb support: 25.6%, right single limb support: 41.6%, left step length 32.7 cm and right step length was 39.3 cm. (See table 7 for detailed gait lab data). These results show that the patients gait is much improved with the device and that some of the improved motor control (for example the bearing more weight on the left leg thus increasing right step length) is retained for at least a short period of time.

TABLE 7

Patient's Gait lab Parameters

| Visit | Velocity (cm/sec) | Left step length (cm) | Right Step length (cm) | Left Single Limb Support (in % of step cycle) | Right Single Limb Support (in % of step cycle) |
|---|---|---|---|---|---|
| 1st (initial) | 37.0 | 21.0 | 25.0 | 19.0 | 42.1 |
| 1st (initial) With the Device | 55.0 | 37.0 | 40.5 | 27.3 | 39.1 |
| 1st (initial) Barefoot retest | 49.0 | 32.7 | 39.3 | 25.6 | 41.6 |
| 2nd (first follow-up) | 73.1 | 42.0 | 47.0 | 33.3 | 39.4 |
| 2nd (first follow-up) With the Device | 92.8 | 52.3 | 56.6 | 35.1 | 39.0 |
| 2nd (first follow-up) Barefoot retest | 80.3 | 46.9 | 49.3 | 34.8 | 39.6 |
| 3rd (second follow-up) | 116.0 | 64.1 | 62.7 | 37.9 | 40.4 |
| 3rd (second follow-up) With the Device | 117 | 65.3 | 64.8 | 37.1 | 39.1 |
| 3rd (second follow-up) Barefoot retest | 115.6 | 64.8 | 64.6 | 37.6 | 39.3 |

Treatment Plan: The patient was briefed about the safety instructions and instructed to start the treatment by wearing the device for a total time of one hour for every day of the first week, out of which a total of 5% to 10% should be spent in weight bearing activities. Thus accumulated weight bearing time should be 3-6 minutes. The patient was seen for follow up consultations 10 days after the initial consultation, 3 weeks after the initial consultation, 5 weeks after the initial consultation and 3 months after the initial consultation.

Treatment Progression: At the end of the initial calibration process the patient immediately felt less pain and his ambulation was much easier with the footwear. In the first follow up he reported that pain was decreased while walking with the footwear (to 1/10 on VAS). He also reported that when he was walking with the footwear he did not need the support of the walker. Gait without the footwear was also significantly better with pain level rated at a maximum of 3/10. Gait lab results showed a large improvement in barefoot gait. Gait velocity was 73.0 cm/sec., left single limb support: 33.3%, right single limb support 39.4%, left step length 42.0 cm. and right step length was 47.0 cm. (see table 7 for details of barefoot gait lab retest). Due to the improvement and due to the fact that differences between right and left single limb support and step length were still significant the patient still needed "off-loading" and asymmetrical level of perturbation. The anterior and posterior BP's of the left footwear were therefore changed to a B level of convexity. Since B level convexity is higher than the A level convexity, one hard spacer was removed from the posterior BP. This was done without changing the position of the BP. A hard spacer was removed from the anterior protuberance as well, without changing its position. Clinical gait assessment revealed the patient had an early-heel rise in the left leg. In order to correct this one soft spacer was removed from the anterior left BP and the patients' heel-rise timing became normalized. The patient was asked not to increase the total wearing time for 3-4 days to allow his neuromuscular control to get accustomed to the new calibration. After the first 4 days the patient was asked to increase the total wearing time of the footwear by 15 minutes a week and maintain 10% of accumulative weight bearing time.

On the second follow up the patient reported that he no longer needed any type of walking aid. His pain level decreased to 1/10 and he reported he had the device on for 2 and half hours every day. During that time he ambulates freely around the house. Gait lab data showed velocity was now 116 cm/sec, left single limb support: 37.9%, right single limb support 40.4%, left step length 64.1 cm. and right step length was 62.7 cm. (see table 7 for details of barefoot gaitlab retest). The anterior and posterior BP's of the left device were therefore changed to a C level convexity. Since C level convexity is higher than the B level of convexity which the left the BP's had in the last calibration one hard spacer was removed from the posterior protuberance. This was done without changing the position of the BP. A hard spacer was removed from the anterior BP as well, without changing its position. Clinical gait assessment showed no gait deviations and the patient reported he had no pain or discomfort. Gait lab data with the device and a barefoot retest are provided in table. 7. The patient was requested to increase the total wearing time of the footwear by 20 minutes a week. He was instructed that within this time frame he should perform one period of continuous indoor walking starting with 10 minutes and increasing by 2 minutes per week. In the follow up consultation conducted 3 months after the initiation of the treatment the patient reported he was pain free and has worked the overall wearing time of the footwear to 5 hours a day. During that time he performed a 25 minute period of continuous indoor walking (see table 7). There were no changes in the calibration made in this follow up consultation. The patient was instructed to continue with the same treatment plan and cone for another follow up consultation in 5 months.

Example 7

Right Bimalleolar Ankle Fracture (Open Reduction and Internal Fixation)

A 37 years old male is presented to the treatment center 10 weeks after a bimalleolar ankle fracture treated by an open reduction and internal fixation.

Case History: The patient has broken his right ankle during a basketball game 10 weeks ago in an inversion mechanism. He was operated that night and was recommended to maintain the leg in non-weight bearing for two weeks. Following the removal of the staples, partial weight bearing was recommended. The patient was instructed by the treating surgeon to increase weight bearing as tolerated and was referred to physiotherapy. He needed a walking stick for outdoors walking. Walking for over 5 minutes was difficult and painful (4/10 on a VAS). The pain was increasing when climbing up or down stairs (5/10 and 6/10 respectively).

Physical Examination: On observation there was a moderate edema around the right foot and ankle. The patient was bearing more weight on the left leg. Ranges of motion measured by a hand held goniometer revealed right dorsiflexion—5 degrees, left dorsiflexion—15 degrees, right plantar-flexion—45 degrees, left plantar-flexion—75 degrees. Palpation of the ankle produced mild tenderness in the anterior joint line and around the lateral malleolus. During clinical gait assessment it was evident that the patient had insufficient dorsiflexion in the right ankle. This led to a shorter stance on the right and reduced the swing phase of the left leg. The patient reported anterior and lateral right ankle pain during mid and late phases of stance. He rated the pain as 5/10 on a VAS.

Imaging and Gait lab: X-rays of the right ankle showed the fracture to be well positioned and fully calloused. There were no apparent signs of ankle or subtalar joint damage. Gait lab data showed gait velocity of 65.1 cm/sec., left step length—43.8 cm., right step length—50.2 cm, left single limb support—43.2%, right single limb support—31.7%.

Therapy-Balancing: The patient's footwear was calibrated and fine tuned during repeated clinical gait assessments with the device. During this process care is taken to reduce the eversion and inversion during heel strike, loading response, mid-stance and toe-off.

Pain: BP's with a B level convexity and "soft" hardness were attached and fixed under the hind-foot and fore-foot of the right boot. In order to reduce the pain during midstance of the right leg (believed to be caused by the limited dorsiflexion) two soft spacers were inserted and fixed between the posterior right BP and the outsole. This brought the right ankle to a slightly plantar-flexed position. In addition, this also created a certain a degree of "off-loading" of the right leg (see previous examples for details of "off-loading"). BP's with C level convexity and hard resilience were attached and fixed to the hind-foot and fore-foot of the left footwear. Since BP's with C level convexity are higher than BP's with B level convexity, the "off loading" of the right leg was now lost. Therefore, two hard spacers were inserted and fixed between the shoe and the right posterior protuberance, additional two hard spacers were inserted and fixed for the right anterior BP. The patients' gait was clinically assessed and showed increased velocity, longer stance period of the right leg and improved step length symmetry. The patient reported that the right ankle pain was now at a level of 2/10 pain. In order to decrease the right ankle pain further the posterior right BP was calibrated and fixed 3 mm anteriorly to its original position. The patient reported that his right ankle pain level was now 1/10. A further anterior calibration of 2 mm of the right posterior BP did not produce any further improvement in either gait quality or pain level. Therefore, the right posterior BP was calibrated and fixed 2 mm back to its previous position.

Heel-Rise Timing: The patient was asked to walk 20 m in order to confirm that he was still balanced and the heel-rise is well timed within the gait cycle. There were no apparent gait deviations regarding heel-rise timing in the left leg or the right leg.

Treatment Plan: The patient was briefed regarding the safety instructions. He was told to wear the device for a total of 45 minutes a day on every day of the first week. Out of that total time he was asked to perform weight bearing activities for an accumulative amount of 9-10 minutes (20% of the total wearing time). The patient was instructed to increase the total wearing time of the footwear by 10 minutes each week of the treatment, while maintaining 20% of accumulative weight bearing time. The patient was seen for follow up consultations in the Treatment center 2 weeks after the initial consultation, 5 weeks after the initial consultation, 3 months after the initial consultation and half a year after the initial consultation.

Treatment Progression: As afore mentioned, the patient had significantly reduced pain and found walking much easier with the footwear during the initial calibration process. On the first follow up consultation the patient reported that he found walking indoors without the footwear easier and less painful than before (pain level for indoor walking 2/10) though he still needed to use the walking cane for longer, outdoor walks. He increased the total wearing time of the footwear to an hour and 15 minutes. Gait lab data showed gait velocity increase to 78.0 cm/sec, right step length and left step length have increased and the symmetry in step length was better (left-48.9 cm. right-52.3 cm.). The single limb support values also improved and had better symmetry (left-41.0% right-33.2%). Due to the positive effects on pain level and gait parameters the calibration was left unchanged. The patient was asked to increase the total wearing time by 15 minutes each week while maintaining the relative 10% of accumulative weight bearing time.

On the second follow up consultation the patient reported he found walking outdoors much less painful (pain level decreased to 1-2/10) and ceased to use the walking cane. He was wearing the device for 2 hours a day and found walking with it, painless. Gait lab parameters were: velocity—105.5 cm/sec. left step length 54.3 cm, right step length—57.1 cm left single limb support—39.5%, right single limb support—37.8%. Due to the pain decrease and the vast improvement on gait lab parameters the "offloading" and the asymmetry in perturbation was thought to be unnecessary. The anterior and posterior BP's of the right device were changed from B level convexity to C level convexity. The soft spacers placed between the outsole and the base of the posterior right BP were removed and then the BP was fixed to the same position. The patients gait was reassessed and the patient reported that he felt mild pain (1/10 on a VAS) during the late stance phase. In order to relieve this pain, the spacer was removed from beneath the anterior right protuberance. The protuberance was fixed back to its position. This brought the right ankle to a slightly plantar-flexed position. The patient then reported that he had no pain in the right ankle when walking with the device. The patient was then instructed to continue with the current total treatment time for a week so as to allow his neuromuscular control to get accustomed to the new calibration. Following that week, he was asked to increase the total treatment time by 15 minutes every week up to a maximum of 4 hours. He was also instructed, after the first week following the consultation, to go about indoor daily activities as normal when wearing the footwear.

On the third follow up the patient reported he did not have any pain in the right ankle. The gait lab parameters are presented in table 8. BP's with a convexity grade D were attached and fixed to the anterior and posterior BP's of both the right and the left devices. The hard spacer was removed from the right posterior protuberance. Following these changes, all BP's (on both right and left devices) were attached and fixed to their previous position. Clinical gait assessment with the device did not reveal any gait deviations and the patient reported he did not have any pain or discomfort. The patient was allowed to walk outside while wearing the footwear.

The invention claimed is:

1. A footwear comprising:

a support member having an inner sole and an upper surface attachable to a foot, and two bulbous protuberances, a forward bulbous protuberance and rearward bulbous protuberance, each has a curved outer contour, protruding from a lower surface of said support member on opposite sides of a latitudinal midline thereof, said latitudinal midline being halfway between a calcaneus support portion and a phalanges support portion of said support member, wherein said forward bulbous protuberance, said rearward bulbous protuberance, or both is/are positioned offset with respect to a longitudinal centerline, wherein the ratio between the surface area of the inner sole to the surface area of a base of at least one bulbous protuberance of the two bulbous protuberances is less than 12:1, wherein, at least one bulbous protuberance of the two bulbous protuberances has a shore hardness of between 15 to 100 Sh A, said footwear is adapted to support the foot only by said two bulbous protuberances when said two protuberances are placed on a ground surface.

2. The footwear of claim 1, wherein the forward bulbous protuberance is positioned laterally offset with respect to a longitudinal centerline.

3. The footwear of claim 1, wherein the rearward bulbous protuberance is positioned medially offset with respect to the longitudinal centerline.

4. The footwear of claim 1, wherein the height of the forward bulbous protuberance is greater than the height of the rearward bulbous protuberance.

5. The footwear of claim 1, wherein the height of the rearward bulbous protuberance is greater than the height of the forward bulbous protuberance.

6. The footwear of claim 1, wherein the forward bulbous protuberance, the rearward bulbous protuberance, or both comprise cleats.

7. The footwear of claim 1, wherein the forward bulbous protuberance, the rearward bulbous protuberance, or both comprises an abrasion resistance of less than 125 $mm^3$ according to the DIN 53516 standard.

8. The footwear of claim 1, wherein the forward bulbous protuberance, the rearward bulbous protuberance, or both comprises a convexity delimited between graphs of function 1:

$$f(x) = \sqrt[8]{5x}$$

and function 2:

$$f(x) = \sqrt[3]{\frac{1}{3}}\,x^2.$$

9. A footwear comprising:

a support member having an inner sole and an upper surface attachable to a foot, and two bulbous protuberances, a forward bulbous protuberance and rearward bulbous protuberance, each has a curved outer contour, protruding from a lower surface of said support member on opposite sides of a latitudinal midline thereof, said latitudinal midline being halfway between a calcaneus support portion and a phalanges support portion of said support member, wherein said forward bulbous protuberance, said rearward bulbous protuberance, or both is/are positioned offset with respect to a longitudinal centerline, wherein the ratio between the surface area of the inner sole to the surface area of a base of at least one bulbous protuberance of the two bulbous protuberances is less than 12:1, wherein the forward bulbous protuberance, the rearward bulbous protuberance, or both comprises a convexity delimited between graphs of function 1:

$$f(x) = \sqrt[8]{5x}$$

and function 2:

$$f(x) = \sqrt[3]{\frac{1}{3}x^2},$$

said footwear is adapted to support the foot only by said two bulbous protuberances when said two protuberances are placed on a ground surface.

10. The footwear of claim 9, wherein at least one bulbous protuberance of the two bulbous protuberances has a shore hardness of between 15 to 100 Sh A.

11. The footwear of claim 9, wherein the forward bulbous protuberance is positioned laterally offset with respect to a longitudinal centerline.

12. The footwear of claim 9, wherein the rearward bulbous protuberance is positioned medially offset with respect to the longitudinal centerline.

13. The footwear of claim 9, wherein the height of the forward bulbous protuberance is greater than the height of the rearward bulbous protuberance.

14. The footwear of claim 9, wherein the height of the rearward bulbous protuberance is greater than the height of the forward bulbous protuberance.

15. A method for preparing footwear, the footwear comprising a support member having an upper surface attachable to a foot, and two bulbous protuberances, a forward bulbous protuberance and a rearward bulbous protuberance, each bulbous protuberance having a curved outer contour, protruding from a lower surface of said support member on opposite sides of a latitudinal midline thereof, said latitudinal midline being halfway between a calcaneus support portion and a phalanges support portion of said support member, wherein the forward bulbous protuberance is positioned laterally offset with respect to a longitudinal centerline, wherein the ratio between the surface area of the inner sole to the surface area of a base of at least one bulbous protuberance of the two bulbous protuberances is less than 12:1, wherein, at least one bulbous protuberance of the two bulbous protuberances has a shore hardness of between 15 to 100 Sh A, said footwear is adapted to support the foot only by said two bulbous protuberances when said two protuberances are placed on a ground surface, the method comprising: positioning at least one protuberance on said lower surface of said support member.

16. The method as claimed in claim 15, wherein said positioning comprises fixing or mounting.

17. The method as claimed in claim 15, wherein said positioning at least one protuberance is positioning two bulbous protuberances.

18. The method as claimed in claim 15, wherein the rearward bulbous protuberance is positioned medially offset with respect to the longitudinal centerline.

19. The method as claimed in claim 15, wherein the height of the forward bulbous protuberance differs from the height of the rearward bulbous protuberance.

20. The method as claimed in claim 1, wherein each of the forward bulbous protuberance and the rearward bulbous protuberance has a convexity delimited between graphs of function 1:

$$f(x) = \sqrt[8]{5x}$$

and function 2:

$$f(x) = \sqrt[3]{\frac{1}{3}x^2}.$$

* * * * *